US008579401B2

(12) United States Patent
Iritani et al.

(10) Patent No.: US 8,579,401 B2
(45) Date of Patent: Nov. 12, 2013

(54) INKJET PRINTING SYSTEM AND INKJET PRINTING METHOD

(75) Inventors: Hinako Iritani, Kawasaki (JP); Yuji Konno, Kawasaki (JP); Yuji Hamasaki, Kawasaki (JP); Takeshi Yazawa, Yokohama (JP); Satoshi Seki, Kawasaki (JP); Yoshio Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 13/217,993

(22) Filed: Aug. 25, 2011

(65) Prior Publication Data

US 2012/0050370 A1 Mar. 1, 2012

(30) Foreign Application Priority Data

Aug. 31, 2010 (JP) ..... 2010-194744

(51) Int. Cl.
*B41J 2/205* (2006.01)
*B41J 29/38* (2006.01)

(52) U.S. Cl.
USPC ..... 347/15; 347/5

(58) Field of Classification Search
USPC ..... 347/21, 5, 15, 14
See application file for complete search history.

(56) References Cited

U.S. PATENT DOCUMENTS

| | | | | |
|---|---|---|---|---|
| 8,444,240 | B2 * | 5/2013 | Kunimine et al. | 347/5 |
| 2011/0050791 | A1 * | 3/2011 | Kagata et al. | 347/21 |
| 2011/0216110 | A1 * | 9/2011 | Kunimine et al. | 347/5 |
| 2012/0050362 | A1 | 3/2012 | Iritani et al. | |
| 2012/0050369 | A1 * | 3/2012 | Seki et al. | 347/15 |
| 2012/0154468 | A1 * | 6/2012 | Takekoshi et al. | 347/14 |

FOREIGN PATENT DOCUMENTS

JP 4066338 A 3/2008

* cited by examiner

*Primary Examiner* — Stephen Meier
*Assistant Examiner* — Carlos A Martinez
(74) *Attorney, Agent, or Firm* — Fitzpatrick, Cella, Harper & Scinto

(57) ABSTRACT

There is provided an inkjet printing apparatus which can restrict each of coloring of reflected light and image clarity within an allowable range required in each of a color mode and a monochromatic mode in any of the modes to output an image with a high grade. For this end, a print duty of each of the first image improving liquid and the second image improving liquid is set in such a manner that a ratio of the print duty of the first image improving liquid having low penetratability to the print duty of the second image improving liquid having high penetratability is higher in the monochromatic mode than that in the color mode. Thereby, an appropriate ratio and an appropriate amount of appropriate kinds of the image improving liquids are applied to each of the color mode and the monochromatic mode.

15 Claims, 21 Drawing Sheets

| | | COLORED INK | | | | | | | IMAGE IMPROVING LIQUID | |
|---|---|---|---|---|---|---|---|---|---|---|
| | | M | LM | C | LC | Y | K | Gy | CL1 | CL2 |
| PIGMENT DISPERSION LIQUID | 1 | 40 | 10 | | | | | | | |
| | 2 | | | 40 | 10 | | | | | |
| | 3 | | | | | 40 | | | | |
| | 4 | | | | | | 30 | 10 | | |
| RESIN WATER SOLUTION B | 5 | | | | | | | | 1 | 2 |
| RESIN WATER SOLUTION C | 6 | | | | | | | | 2 | 1 |
| GLYCERIN | | 5.0 | 5.0 | 5.0 | 5.0 | 5.0 | 5.0 | 5.0 | 5.0 | 5.0 |
| DIETHYLENE GLYCOL | | 5.0 | 5.0 | 5.0 | 5.0 | 5.0 | 5.0 | 5.0 | 5.0 | 5.0 |
| POLYETHYLENE GLYCOL 1000 | | 5.0 | 5.0 | 5.0 | 5.0 | 5.0 | 5.0 | 5.0 | 5.0 | 5.0 |
| SURFYNOL(REGISTERED TRADEMARK)465 | | 1.0 | 1.0 | 1.0 | 1.0 | 1.0 | 1.0 | 1.0 | 1.0 | 1.0 |
| ION-EXCHANGE WATER | | 44 | 74 | 44 | 74 | 44 | 54 | 74 | 81 | 81 |

FIG.7

| PRINT MEDIUM KIND | PRINT DUTY(%) | | | | RELATION OF PRINT DUTY RATIO (CL1/CL2) |
|---|---|---|---|---|---|
| | COLOR MODE | | MONOCHROMATIC MODE | | |
| | CL1 | CL2 | CL1 | CL2 | |
| GLOSSY PAPER A | 2 | 18 | 18 | 2 | COLOR < MONOCHROME |
| GLOSSY PAPER B | 5 | 15 | 15 | 5 | COLOR < MONOCHROME |
| GLOSSY PAPER C | 2 | 18 | 10 | 10 | COLOR < MONOCHROME |

FIG.15

INKJET PRINTING SYSTEM AND INKJET PRINTING METHOD

BACKGROUND OF THE INVENTION

1. Field of the Invention

This invention relates to an inkjet printing system for printing an image on a print medium using an image improving liquid in addition to an ink. Particularly the present invention relates to an inkjet printing system and an inkjet printing method for, in a case of using an ink containing a pigment in a colorant, reducing coloring of reflected light due to thin film interference or bronze of an image while securing image clarity.

2. Description of the Related Art

In a recent inkjet printing market, there is provided an inkjet printing apparatus where there is a demand for output of an image with a high grade comparable to a silver photograph and also weather resistance of the outputted image, and a pigment ink having high robustness of a colorant itself is used. In the image printed by the pigment ink, however, for example, a new harmful effect to an image such as a phenomenon (for example, bronze) of reflecting light having a color different from a colorant on a surface of the image is confirmed. Hereinafter, the above harmful effect to the image will be briefly explained.

In general, the phenomenon of reflecting the light having the color different from the colorant on the surface of the image is brought in by thin film interference or bronze. The thin film interference is a phenomenon which occurs in a case where a thickness of a printed colorant layer is in sync with a wavelength of light and in which a color of the reflected light changes depending on a reflection angle, that is, an observation angle. A printed matter distinguishing in coloring of the reflected light is observed with a color different from a color desired to be originally expressed by an observer, giving a discomfort feeling. On the other hand, the bronze is considered as a phenomenon occurring as a result that when pigment colorant particles are exposed on a surface of a print medium, a ratio of wavelength components in an absorption band of the pigment increases in the reflected light by selective reflection of light on a pigment particle surface. Distinguishableness of the bronze differs depending on the kind or an amount of the colorant, for example, in a case of using cyan pigments, the reddish reflected light is visible.

For reducing the coloring of the reflected light to be generated due to such thin film interference or bronze, there is proposed a method for laminating a transparent film on a print surface to prevent pigment particles from being exposed on the surface of the print medium. In addition, there is proposed a method for putting an additive such as titanium dioxides to a colored ink.

Further, Japanese Patent Publication No. 4066338 discloses a technology of over-coating a print medium with a yellow ink. This is a method in which, after forming an image on the print medium by using cyan, magenta, and yellow inks, the image is over-coated with the yellow ink causing less bronze in a low print ratio, thus reducing the bronze in a cyan hue particularly.

In addition, there is proposed a method in which a non-colored, transparent clear ink (image improving liquid) is prepared in addition to the pigment ink for image formation and is then applied on an image, thus preventing exposure of the pigment and restricting occurrence of the thin film interference to reduce the coloring of the reflected light.

In the method for laminating the transparent film, however, there occur various problems such as an increase in cost of the apparatus due to a provision of the laminate mechanism or an increase in hours or labors required in the laminate operation. The method for putting the additive such as titanium oxides into the colored ink raises a problem of ejection instability or the like. Further, since in the specification of Japanese Patent Publication No. 4066338, not the clear ink but the yellow ink is used, an entire image including a blank region is yellowish, therefore narrowing a color expression region or losing a gray balance.

Further, also in a method for coating a pigment surface with a clear ink, there is a possibility that glossy properties, particularly image clarity of a print medium is damaged. For example, in a case where a print is performed on a glossy paper by a pigment ink, since the pigment ink tends to be easily left on the surface, convexity and concavity are formed on the surface of the print medium. When the clear ink for bronze prevention is applied on the print medium surface in such a state, layers of printing portions are more highly laminated to develop the convexity and concavity to be larger on the surface. As a result, the coloring of the reflected light due to the bronze or the thin film interference is certainly alleviated, but the image clarity is remarkably reduced to bring in a new image problem. Therefore, in a case of restricting the coloring of the reflected light by the clear ink, the characteristic and the application amount of the clear ink are required to be adjusted in consideration of the coloring of the reflected light and the image clarity in such a manner that both of them can be restricted within a degree of being not problematic on the image.

On the other hand, according to the study of the present inventors, the appropriate application amount of the clear ink depends on the feature and the application of the image to be printed. Specially as comparing a case of printing a color photograph using many kinds of pigment inks (CMYK) with a case of printing a monochromatic photograph using one or two kinds of pigment inks (K and Gy), the degree of the coloring of the reflected light originally differs therebetween. On top of that, the deterioration degree of the image clarity also differs at the time of applying the same amount of the clear ink. In addition, a range or accuracy in color reproduction to be required also differs between the color photograph and the monochromatic photograph. That is, between the color photograph and the monochromatic photograph, the characteristic and the amount of the clear ink to be applied will differ with each other for restricting both the coloring of the reflected light and the image clarity to be within a range of being not problematic on the image.

Particularly in recent years, for meeting a demand for a color photograph realizing "a wide color reproduction region" or a monochromatic photograph having "an excellent gray balance", there is provided an inkjet printing apparatus for preparing particular printing modes (color mode and monochromatic mode) for realizing these color and monochromatic photographs. In the meantime, image output having no problem on the coloring of the reflected light and the image clarity is expected in any of the printing modes. In any of the conventional methods, however, the kind and amount of the clear ink can not be thus adjusted based upon the feature or the application of the image, and it is difficult to output the image in which the coloring of the reflected light and the image clarity are restricted within an allowance range in every mode.

SUMMARY OF THE INVENTION

The present invention is made in view of the foregoing problem. Therefore, an object of the present invention is to provide an inkjet printing apparatus which, in any of a color mode and a monochromatic mode, can restrict coloring of reflected light and image clarity to be within an allowance range required in each mode to output an image with a high grade.

In a first aspect of the present invention, there is provided an inkjet printing system using a print head for ejecting a plurality of pigment inks, a first image improving liquid, and a second image improving liquid being more penetrative into a print medium than the first image improving liquid to print an image on the print medium, comprising: a setting unit configured to set, to each of a color mode for using the plurality of the pigment inks to print on the print medium based on color image data and a monochromatic mode for using the plurality of the pigment inks having the less kind in number than the color mode to print on the print medium based on an achromatic image data, a print duty of each of the first image improving liquid and the second image improving liquid to the print medium, wherein the setting unit sets the print duty of each of the first image improving liquid and the second image improving liquid in such a manner that a ratio of the print duty of the first image improving liquid to the print duty of the second image improving liquid is higher in the monochromatic mode than that in the color mode.

In a second aspect of the present invention, there is provided an inkjet printing system using a print head for ejecting a plurality of pigment inks, a first image improving liquid, and a second image improving liquid being more penetrative into a print medium than the first image improving liquid to print an image on the print medium, comprising: a setting unit configured to set, to each of a color mode for using the plurality of the pigment inks to print on the print medium based on color image data and a monochromatic mode for using the plurality of the pigment inks having the less kind in number than the color mode to print on the print medium based on an achromatic image data, a used amount of each of the first image improving liquid and the second image improving liquid to the print medium, wherein the setting unit sets the used amount of each of the first image improving liquid and the second image improving liquid in such a manner that a ratio of the used amount of the first image improving liquid for printing an intermediate gradation image to the print duty of the second image improving liquid in the monochromatic mode is higher than that in the color mode.

In a third aspect of the present invention, there is provided an inkjet printing method for using a print head for ejecting a plurality of pigment inks, a first image improving liquid, and a second image improving liquid having higher penetratability onto a print medium than the first image improving liquid to print an image on the print medium, comprising: a printing step for printing an image by a color mode for using the plurality of the pigment inks to print a color image on the print medium or a monochromatic mode for using the plurality of the pigment inks having the less kind in number than the color mode to print an achromatic image on the print medium, wherein in the printing step, a ratio of the print duty of the first image improving liquid to the print duty of the second image improving liquid is higher in the monochromatic mode than that in the color mode.

Further features of the present invention will become apparent from the following description of exemplary embodiments (with reference to the attached drawings).

BRIEF DESCRIPTION OF THE DRAWINGS

FIG. 7 is a diagram showing component concentrations of pigment inks and image improving liquids used in the embodiment;

FIG. 15 is a diagram showing an example in which an application amount of an image improving liquid differs depending on the kind of a glossy paper;

DESCRIPTION OF THE EMBODIMENTS

Hereinafter, preferred embodiments in the present invention will be explained with reference to the accompanying drawings.

(First Embodiment)

First, in the embodiment of the present invention, an explanation will be made of image clarity and a degree in coloring (chroma) of regular reflected light which are indexes of image evaluation. The image clarity, for example, can be measured using "Image clarity measurement method of anodic oxide coating of aluminum and aluminum alloy" of JIS H8686 or "Optical characteristic test method of plastics" of JIS J7105 and expresses distinction of an image reflected and formed on a print medium.

Figure 1A:
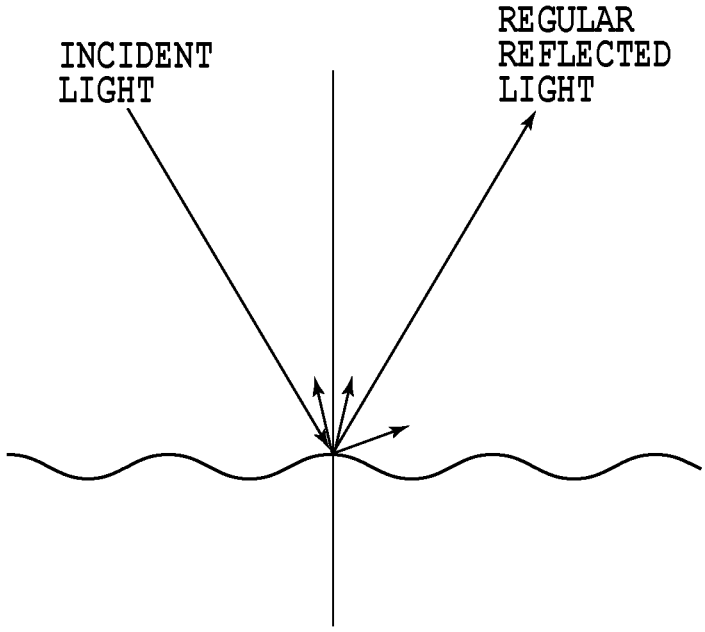
FIGS. 1A and 1B are diagrams each showing roughness of an image surface and amounts or directions of reflected light.
Figure 1B:
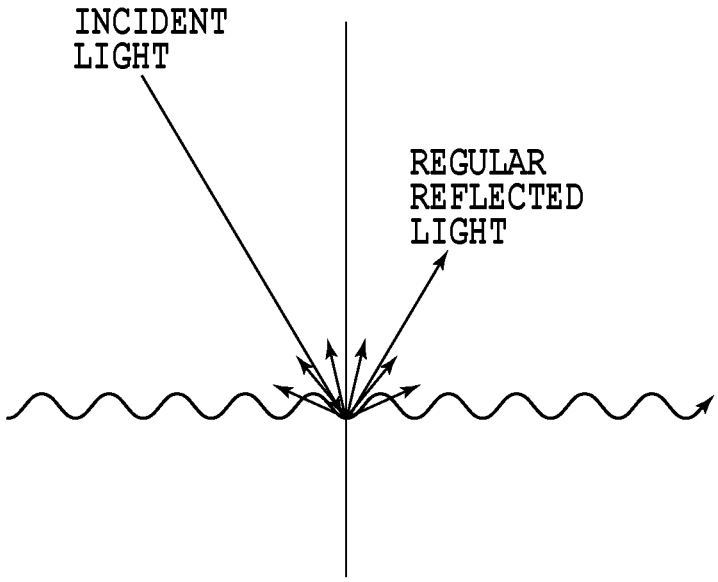

FIGS. 1A and 1B are diagrams each showing that an amount and a direction of reflected light differ corresponding to the roughness of an image surface. As shown in these figures, generally as the surface is rougher and convexity and concavity increase, there is a tendency that the reflected light is more easily scattered and the image clarity is measured to be smaller. For example, in a case where an illumination image reflected and formed on the print medium blurs, a value of the image clarity is low.

The coloring of the regular reflected light can be measured by using Three-Dimensional Gonio Spectrophotometric Colorimetry System of Murakami Color Research Laboratory (GCMS-4). Light is irradiated on a printed image in the direction of an angle of 45° thereto and the reflected light is received in a position of an angle of 45° in the reverse direction to measure a spectral strength of the regular reflected light. Further, using a bronze characteristic calculation method shown hereinafter, the chroma of the regular reflected light can be calculated from the measured spectral strength. As the coloring of the regular reflected light is the smaller, a measurement value of the chroma of the regular reflected light is the smaller.

Figure 2:
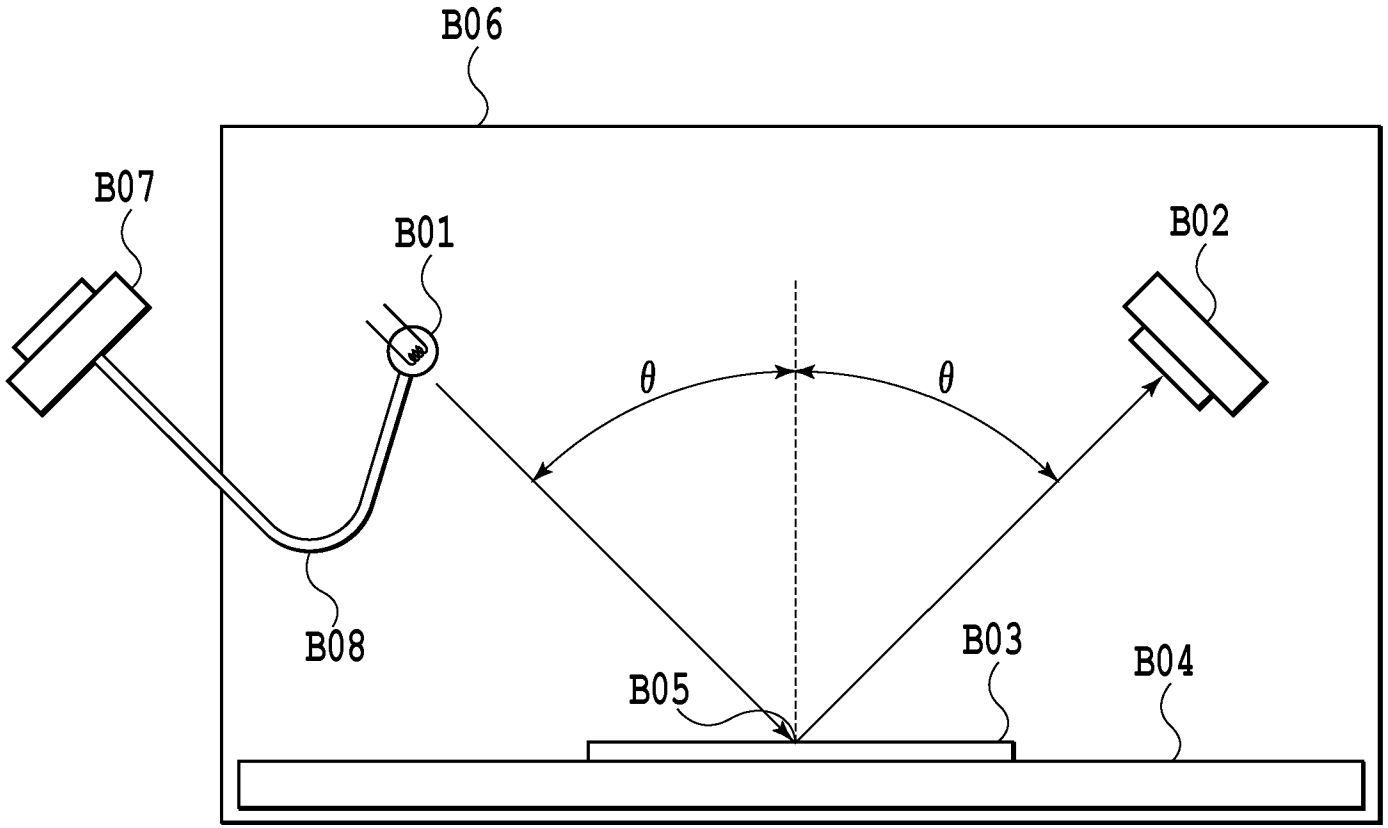
FIG. 2 is a schematic diagram of a reflected light measurement system.

FIG. 2 is a schematic diagram of the measurement system. A series of devices in the measurement system are accommodated in a boxy light shielding unit B06 for shielding light from an outside. Inside the light shielding unit B06, the light irradiated from an illumination unit B01 is incident at an incidence angle of θ on a measured portion of a print medium B03 positioned on a stationary platform B04, and the regular reflected light is detected by a light detecting unit B02. Here, when a spectral strength of the regular reflected light measured by the light detecting unit B02 is indicated at Rx(λ), tri-stimulus values Xx Yx Zx of the regular reflected light can be calculated according to the following formula (Formula 1).

$$Xx = \int_{380}^{780} Rx(\lambda)\bar{x}(\lambda)\,d\lambda \qquad \text{(Formula 1)}$$

$$Yx = \int_{380}^{780} Rx(\lambda)\bar{y}(\lambda)\,d\lambda$$

$$Zx = \int_{380}^{780} Rx(\lambda)\bar{z}(\lambda)\,d\lambda$$

However, in the above Formula (1), because of measuring the regular reflected light in an optical system in FIG. 2, for example, in a print medium in which a degree of gloss as a glossy paper is large, a range of the measurement value of the regular reflected light is close to the measurement of an optical source. That is, the optical system becomes similar to a measurement system directly measuring the light from the optical source. Therefore, different from the tri-stimulus values of an object color by regular reflection, the spectral strength of the regular reflected light is assumed as a relative spectral distribution of the optical source and is calculated according to a calculation method of the tri-stimulus values of an optical source color. Here, functions in Formula (1), $$\bar{x}(\lambda), \bar{y}(\lambda), \bar{z}(\lambda),$$

are color matching functions of JIS Z 8782.

In addition, here, normalization by multiplication of a proportionality constant is not performed, but normalization of multiplying the Formula (2) or the like may be performed.

$$K = \frac{100}{\int_{380}^{780} y(\lambda)d\lambda} \qquad \text{(Formula 2)}$$

A white board such as a perfect scattering reflective body is used as a measurement object, and a spectral strength of the regular reflected light is measured by B02. From a spectral strength S(λ) of the illumination B01 measured thereby, tri-stimulus values Xs Ys Zs of the illumination are calculated according to the following formula (3). The formula (3) is based upon the calculation method of the tri-stimulus values of the optical source color and a conversion formula for calculating the tri-stimulus values Xs Ys Zs from the spectral data of the above illumination.

$$Xs = k\int_{380}^{780} Sx(\lambda)\bar{x}(\lambda)\,d\lambda \qquad \text{(Formula 3)}$$

$$Ys = k\int_{380}^{780} Sx(\lambda)\bar{y}(\lambda)\,d\lambda$$

$$Zs = k\int_{380}^{780} Sx(\lambda)\bar{z}(\lambda)\,d\lambda$$

Here, k in Formula (3) is a proportionality constant and is defined in such a manner that a value of Ys in the tri-stimulus values is in agreement with the luminous quantity.

Next, L*a*b* value of the regular reflection of the print medium B03 is calculated based upon JIS Z 8729 from the tri-stimulus values Xx Yx Zx of the regular reflected light of the print medium B03 as an evaluation object detected by B02 and the tri-stimulus values Xs Ys Zs of the optical source B01. However, as to values of X, Y and Z in Formula (1) to Formula (4) of JIS Z 8729, the tri-stimulus values (Xx, Yx and Zx) of the regular reflected light of the print medium B03 are used, and as to values of Xn, Yn and Zn, the tri-stimulus values (Xs, Ys and Zs) of the optical source B01 are used. As a result, values of a* and b* are calculated according to the following Formula (4).

$$K = \frac{100}{\int_{380}^{780} y(\lambda)d\lambda} \qquad \text{(Formula 4)}$$

Hereinafter, the construction of the apparatus, the ink component construction and the image process used in the embodiment of the present invention will be in detail explained.

Figure 3:
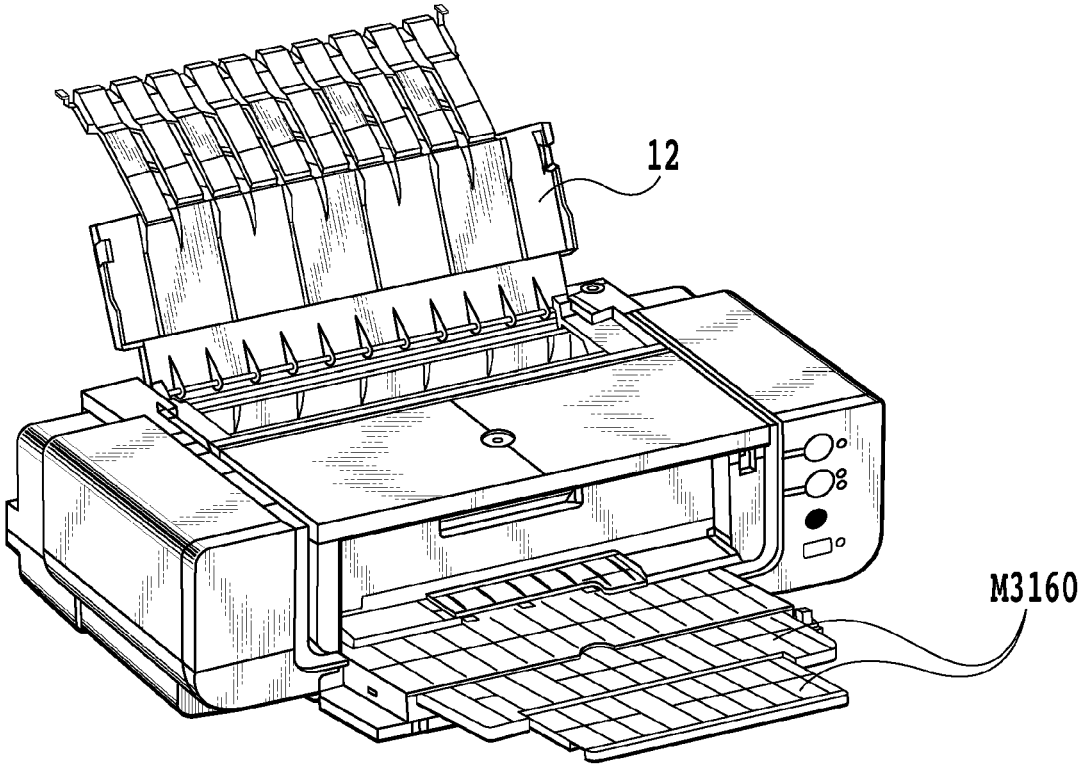
FIG. 3 is a perspective view showing an outside appearance of an inkjet printing apparatus applied in an embodiment.

FIG. 3 is a perspective view showing an outside appearance of the inkjet printing apparatus used in the inkjet printing system in the present embodiment. A print medium fed inside of the apparatus from a feeding tray 12 is discharged to a discharge tray M3160 after printing an image thereon.

Figure 4:
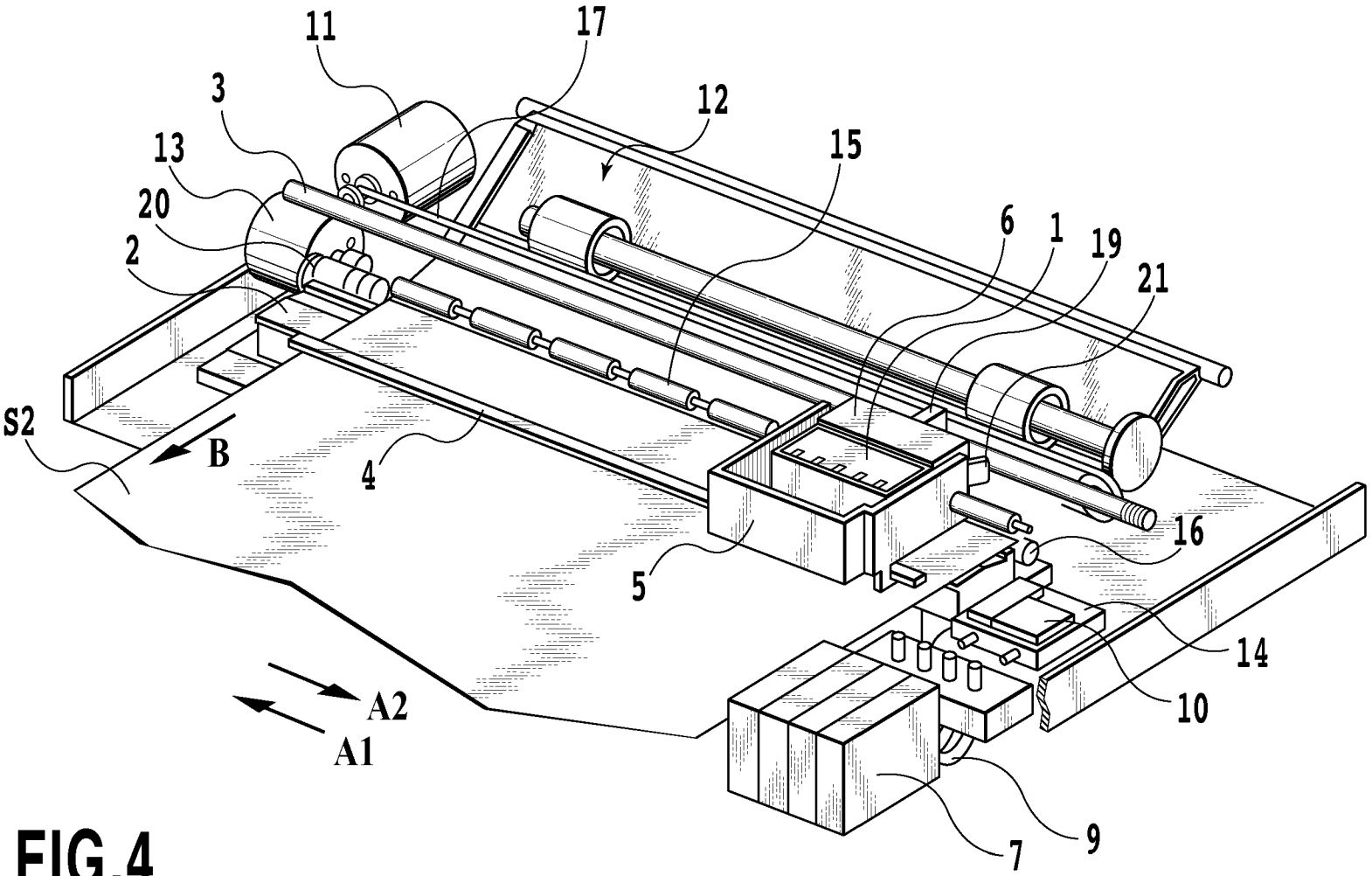
FIG. 4 is a perspective view for explaining the internal construction of the inkjet printing apparatus.

FIG. 4 is a perspective view for explaining the internal construction of the inkjet printing apparatus. A print head 1 mounted in a carriage 5 reciprocally moves in the directions of arrows A1 and A2 along a carriage shaft 3 and a guide rail 4 and at the same time, ejects inks from nozzles to print an image on a print medium S2. The print medium S2 corresponding to a portion on which the print head 1 performs a print is supported by a platen 2 at the lower side to keep a print medium surface to be in parallel with an ejection opening face of the print head 1.

The print head 1 in the present embodiment has a plurality of nozzle lines which can eject pigment inks in different colors and non-colored image improving liquid. A detailed construction of these nozzle lines will be described later. The ink and the image improving liquid to be supplied to the nozzle lines are stored in ink tanks 7 fixed inside the apparatus and are supplied via supply passages 9 to sub tanks mounted in the carriage 5. The sub tank resupplies the ink corresponding to an amount of the ink consumed from the print head 1, to the print head 1. In the present embodiment, a head cartridge 6 is constructed of the sub tank and the print head 1 integrally formed and the head cartridge 6 is mounted in the carriage 5.

A reciprocal movement of the carriage 5 is performed by rotating a timing belt tightened in the apparatus with a drive force of a carriage motor 11. At the time the carriage 5 moves, an encoder sensor 21 provided in the carriage 5 reads scale marks of a linear scale 19 disposed along the movement direction of the carriage 5 to detect a position of the carriage 5.

In the middle when the carriage 5 reciprocally moves at a predetermined speed, the print head 1 ejects inks toward the print medium S2 from a plurality of nozzles in a predetermined frequency. An image corresponding to one line of the print head 1 is printed on the print medium S2 by one time of the main scan. When the print corresponding to such one line is completed, the print medium S2 is conveyed in the direction of an arrow B by a distance corresponding to a print width of one line. Such conveyance movement of the print medium is performed by rotating a conveyance roller 16 using a conveyance motor 13 as a drive force via a linear wheel 20 in a state the conveyance roller 16 holds the print medium together with a pinch roller 15 therebetween. An image is step by step printed on the print medium S2 by alternately performing the main scan by the print head 1 and the conveyance movement of the print medium as described above.

A recovery unit 14, a head cap 10 and the like for executing a maintenance process to the print head 1 are disposed in a home position of the carriage 5. The print head 1 moves to the home position as needed, wherein the recovery process for forcibly sucking inks from the ejection openings, a preliminary ejection process for performing ejection independent from a print toward the head cap 10, and the like are executed.

Figure 5:
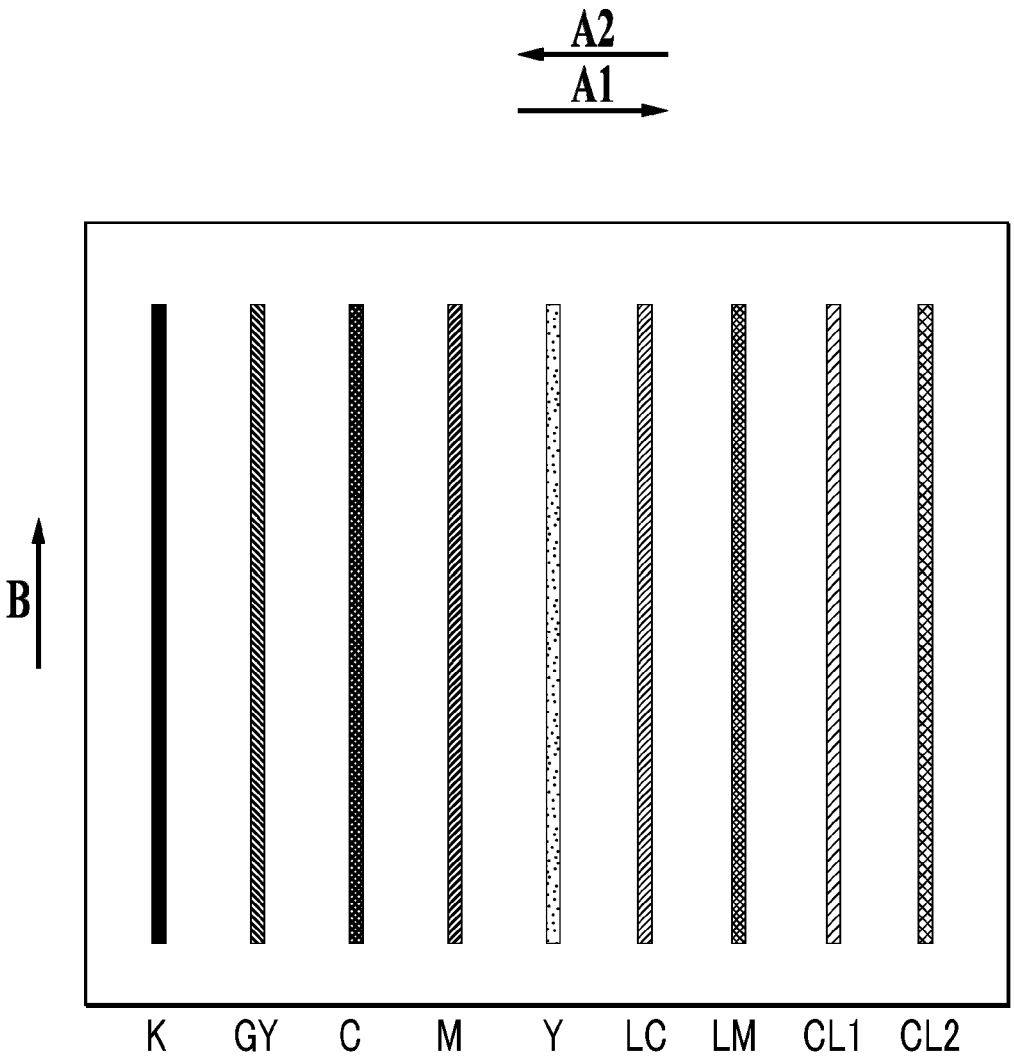
FIG. 5 is a diagram for explaining an arrangement state of a plurality of nozzle lines of a print head.

FIG. 5 is a diagram for explaining an arrangement state of a plurality of nozzle lines disposed in the print head 1. In the present embodiment, pigment inks of seven colors composed of cyan (C), magenta (M), yellow (Y), black (K), light cyan (LC), light magenta (LM), and gray (Gy) are used as colored inks. A first image improving liquid (CL1) and a second image improving liquid (CL2) are prepared for improving image quality printed by the pigment ink. The nine kinds of the liquids are ejected by the respective nozzle lines of the nine lines disposed in parallel in a main scan direction as shown in FIG. 5. It should be noted that 768 nozzles are arranged in the direction of an arrow B for each nozzle line.

Figure 6:
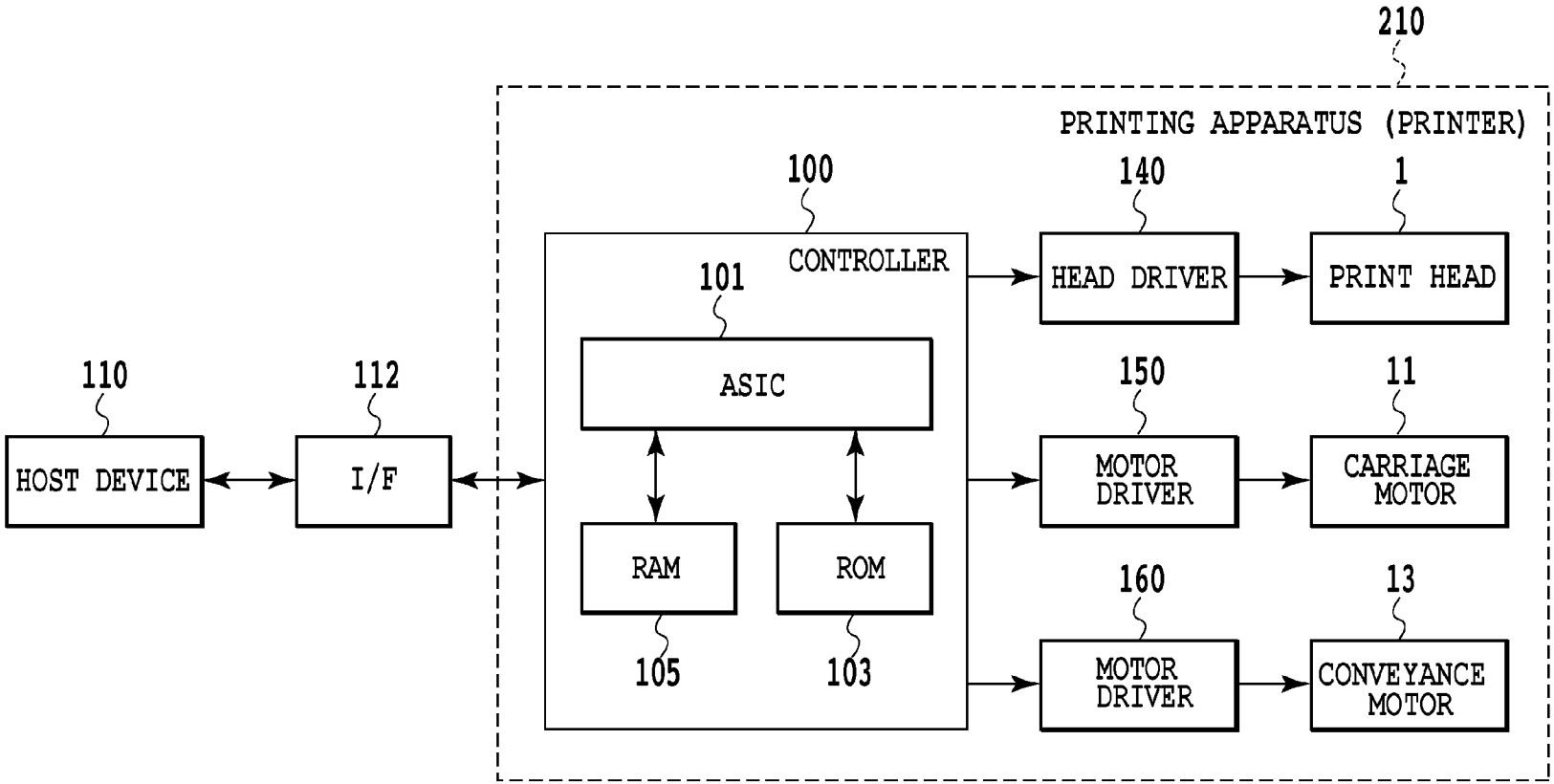
FIG. 6 is a block diagram showing the control construction in the inkjet printing apparatus.

FIG. 6 is a block diagram showing the control construction of the inkjet printing apparatus in the present embodiment. A controller 100 is a main control unit and includes, for example, an ASIC 101 in the microcomputer form, a ROM 103, and a RAM 105. The ROM 103 stores a dot arrangement pattern, a mask pattern, and other fixed data therein. The RAM 105 is provided with a region for developing image data, a region for operations, and the like. The ASIC 101 executes a series of processes from a process of reading out programs from the ROM 103 to a process of printing the image data onto the print medium.

A host device 110 is a supply source of the image data to be described later (a computer executing the production, process, and the like of data of an image relating to a print and the like, and in addition thereto, may be the form of a reader unit for image reading, and the like). The image data, other commands, status signals and the like are communicated with the controller 100 via an interface (I/F) 112.

A head driver 140 is a driver for driving the print head 1 corresponding to print data and the like. A motor driver 150 is a driver for driving the carriage motor 11, and a motor driver 160 is a driver for driving the conveyance motor 13.

Next, components constituting each of the pigment ink and the image improving liquid used in the inkjet printing apparatus according to the present embodiment will be explained.

(Aqueous Medium)

It is preferable to use an aqueous medium containing water and a water-soluble organic solvent as an ink used in the present invention. The content (% by weight) of the water soluble organic solvent in the ink is preferably 3.0% by weight or more to 50.0% by weight or less on a basis of all the weights of the ink. The content (% by weight) of the water in the ink is preferably 50.0% by weight or more to 95.0% by weight or less on a basis of all the weights of the ink.

The water soluble organic solvent may specially include solvents as follows, for example: alkyl alcohols of 1 to 6 of the carbon numbers such as methanol, ethanol, propanol, propanediol, butanol, butadiol, pentanol, pentanediol, hexanol, and hexanediol, amides such as dimethylformamide, and dimethylacetamide, ketones or ketoalcohols such as acetone, and diacetone alcohol, ethers such as tetrahydroroflane, and diokyxane, polyalkylene glycols having an average monocular weight of 200, 300, 400, 600, 1000 or the like such as polyethylene glycol, and polypropylene glycol, alkylene glycols having alkylenes of 2 to 6 of the carbon numbers such as ethylene glycol, propylene glycol, butylene glycol, triethylene glycol, 1,2,6-hexanetriol, a thiodiglycol, hexylene glycol, and diethylene glycol, lower alkyletheraceteto such as polyethleneglycolmonomethyletheraceteto, lower alkylethers of polyhydric alcohol such as glycerin, ethylene glycol monomethyl (or ethyl)ether, diethylene glycol monomethyl (or ethyl) ether, and triethylene glycol monomethyl (or ethyl) ether, N-methyl-2-pyrrolidone, 2-pyrrolidone, 1,3-dimethyl-2-imidazolidinone, and the like. It is preferable to use deionized water (ion exchange water) as water.

(Pigment)

It is preferable to use carbon black or an organic pigment as a pigment. The content (% by weight) of the pigment in the ink is preferably 0.1% by weight or more to 15.0% by weight or less on a basis of all the weights of the ink.

It is preferable that the black ink uses the carbon black such as furnace black, lamp black, acetylene black, and channel black as the pigment. Specially the following commercial items may be used as the black ink, for example. Reivan: 7000, 5750, 5250, 5000ULTRA, 3500, 2000, 1500, 1250, 1200, 1190ULTRA-II, 1170, 1255 (the above made by Columbia). Black pearls L, Regal: 330R, 400R, 660R, Mogul L, Monarch: 700, 800, 880, 900, 1000, 1100, 1300, 1400, 2000, Valcan XC-72R (above by Cabot Corp.). Color Black: FW1, FW2, FW2V, FW18, FW200, 5150, 5160, 5170, Prince Tex: 35, U, V, 140U, 140V, Special Black: 6, 5, 4A, 4 (above by Degussa). No. 25, No. 33, No. 40, No. 47, No. 52, No. 900, No. 2300, MCF-88, MA600, MA7, MA8, MA100 (above by Mitsubishi Chemical). In addition, carbon black freshly prepared for the present invention may be used. It goes without saying that the present invention is not limited to the above and any of the conventional carbon blacks may be used. Further, the pigment is not limited to the carbon black, but black magnetic particles such as magnetite and ferrite or titanium black may be used as a pigment.

Specific examples of organic pigments are, for example, as follows: Insoluble azo pigments such as toluidine red, toluidine maroon, hansa yellow, benzidine yellow, and pirazoron red. Soluble azo pigments such as little red, helio bordeaux, pigment scarlet, and permanent red 2B. Derivatives from vat dyestuff, such as alizarin, indanthrone, and thio-indigo maroon. Phthalocyanine pigments such as phthalocyanine blue, and phthalocyanine green. Quinacridone pigments such as quinacridone red, and quinacridone magenta. Perylene pigments such as perylene red, and perylene scarlet. Isoindolinone pigments such as isoindolinone yellow, isoindolinone orange, and benzimidazolone red. Imidazolone pigments such as benzimidazolone yellow, benzimidazolone orange, and benzimidazolone red. Pyranthrone pigments such as pyranthrone red, and pyranthrone orange. Iindigo pigments, condensation azo pigments, thioindigo pigments, and diketopyrrolopyrrole pigments. flavansron yellow, acylamides yellow, quinophthalone yellow, nickel azo yellow, copper azomethine yellow, inero copper, non-peri orange, anthrone orange, diansrakinony red, dioxazine violet, and the like. It goes without saying that the present invention is not limited to the above.

Also, by indicating organic pigments with the color index (C.I.) numbers, for example, the following items may be used. C.I. pigment yellows: 12, 13, 14, 17, 20, 24, 74, 83, 86, 93, 97, 109, 110, 117, 120, 12 5, 128, 137, 138, 147, 148, 150, 151, 153, 154, 166, 168, 180, 185, and the like. C.I. pigment oranged: 16, 36, 43, 51, 55, 59, 61, 71, and the like. C.I. pigment reds: 9, 48, 49, 52, 53, 57, 97, 122, 123, 149, 168, 175, 176, 177, 180, 19 2, and the like. Likewise, 215, 216, 217, 220, 223, 224, 226, 227, 228, 238, 240, 254, 255, 272, and the like. C.I. pigment violets: 19, 23, 29, 30, 37, 40, 50, and the like. C.I. pigment blues: 15, 15:1, 15:3, 15:4, 15:6, 22, 60, 64, and the like. C.I. pigment greens: 7, 36, and the like. C.I. pigment browns: 23, 25, 26, and the like. It goes without saying that the present invention is not limited to the above.

(Dispersant)

As a dispersant for dispersing the pigment as described above to an aqueous medium, any dispersant having water solubility may be used. Among others, particularly the dispersant having a weight average molecular weight which is from 1.000 or more to 30.000 or less is preferable, more preferably from 3.000 or more to 15.000 or less. The content (% by weight) of the dispersants in the ink is preferably 0.1% by weight more to 5.0% by weight or less on a basis of all the weights of the ink.

Specially the following items may be used as the dispersant, for example. Styrene, vinyl naphthalene, aliphatic alcohol ester of α, β-ethylene unsaturated carboxylic acid, acrylic acid, maleic acid, itaconic acid, fumaric acid, vinyl acetate, vinyl pyrrolidone, acryl amide, or polymer having a monomer as these derivatives. It should be noted that it is preferable that one or more of the monomers constituting the polymer are hydrophilic monomers. Block copolymer, random copolymer, graft copolymer, and salt of these may be used. In addition, natural resins such as rosin, shellac, and starch may be used. These resins are soluble in a water solution dissolving base therein, that is, preferably of an alkali soluble type.

(Surfactant)

For adjusting a surface tension of inks constituting an ink set, it is preferable to use a surfactant such as anionic surfactant, non-ionic surfactant, amphoteric surfactant or the like. Specially polyoxyethylene alkyleter, polyoxyethylenealkylphenols, acetylene glycol compounds, acetylene glycol ethylene oxide additives or the like may be used.

(Other Component)

The ink constituting the ink set, for maintaining moisture retention properties, may contain moisture solid components such as urea, urea derivatives, trimethylolpropane, and trimethylolethane in addition to the above components. The content (% by weight) of the moisturing solid components in the ink is 0.1% by weight or more to 20.0% by weight or less, and preferably 3.0% by weight or more to 10.0% by weight or less, based upon all the weights of the ink. The ink constituting the ink set, in addition to the aforementioned components, may contain various additives such as pH regulators, antirust, antiseptic, preservatives against mold, antioxidants, anti-reduction agents, and evaporation accelerators as needed.

Next, the ink used in the present embodiment will be more specially explained. The present invention is not limited to the following embodiments unless it is out of the sprit of the present invention. It should be noted that "part" and "%" described in the specification are defined on a basis of weight unless particularly specified.

(Preparation of Resin Water Solution A)

A random copolymer of styrene/acryl acid having an acid value of 200 mgKOH/g and a weight-average molecular weight of 10,000 was neutralized to one equal amount by potassium hydroxides. Thereafter, it was prepared by water so that a concentration of the resin components was 10.0%, obtaining a resin water solution A.

(Preparation of Resin Water Solution B→Permeating Polymer)

The random copolymer of the styrene/acryl acid having the acid value of 200 mgKOH/g and the weight-average molecular weight of 10.000 used in the resin water solution A is changed into the following material. That is, it is changed into a random copolymer of styrene/n-butyl acrylate/acryl acid=23/37/37 having an acid value of 288 mgKOH/g and a weight-average molecular weight of 10.000, and a monomer composition. A resin water solution B is prepared in the same way as the resin water solution A, other than the above. In consequence, the resin water solution B which is more penetrate than that of the resin water solution A is obtained.

(Preparation of Resin Water Solution C→Polymer Difficult to Permeate)

The random copolymer of the styrene/acryl acid having the acid value of 200 mgKOH/g and the weight-average molecular weight of 10.000 used in the resin water solution A is changed into the following material. That is, it is changed into a random copolymer of styrene/n-butyl acrylate/acryl acid=33/30/27 having an acid value of 210 mgKOH/g and a weight-average molecular weight of 10.000, and a monomer composition. A resin water solution C is prepared in the same way as the resin water solution A, other than the above. In consequence, the resin water solution C which is less penetrative than that of the resin water solution A is obtained.

(Preparation of Pigment Dispersion Liquids 1 to 4)

The pigment dispersion liquids 1 to 4 were prepared according to the following procedure.

<Preparation of Pigment Dispersion Liquid 1 Containing C.I. Pigment Red 122>

10 parts of pigments (C.I. pigment red 122), 20 parts of resin water solution A, and 70 parts of ion exchange water are mixed, which is dispersed for three hours using a batch type vertical sand mill. Thereafter, bulky particles are eliminated by a centrifugal separation process. Further, the pigment dispersion liquid is pressure-filtered by a cellulose acetate filter (made by Advantech) having a pore size of 3.0 μm to obtain a pigment dispersion liquid 1 having a pigment concentration of 10% by weight.

<Preparation of Pigment Dispersion Liquid 2 Containing C.I. Pigment Blue 15:3>

10 parts of pigments (C.I. pigment blue 15:3), 20 parts of resin water solution A, and 70 parts of ion exchange water are mixed, which is dispersed for five hours using a batch type vertical sand mill. Thereafter, bulky particles are eliminated by a centrifugal separation process. Further, the pigment dispersion liquid is pressure-filtered by a cellulose acetate filter (made by Advantech) having a pore size of 3.0 μm to obtain a pigment dispersion liquid 2 having a pigment concentration of 10% by weight.

<Preparation of Pigment Dispersion Liquid 3 Containing C.I. Pigment Yellow 74>

10 parts of pigments (C.I. pigment yellow 74), 20 parts of resin water solution A, and 70 parts of ion exchange water are mixed, which is dispersed for one hour using a batch type vertical sand mill. Thereafter, bulky particles are eliminated by a centrifugal separation process. Further, the pigment dispersion liquid is pressure-filtered by a cellulose acetate filter (made by Advantech) having a pore size of 3.0 μm to obtain a pigment dispersion liquid 3 having a pigment concentration of 10% by weight.

<Preparation of Pigment Dispersion Liquid 4 Containing C.I. Pigment Black 7>

10 parts of carbon black pigments (C.I. pigment black 7), 20 parts of resin water solution A, and 70 parts of ion exchange water are mixed, which is dispersed for three hours using a batch type vertical sand mill. A circumferential speed at dispersing is set to twice that at the time of preparing the pigment dispersion liquid 1. Thereafter, bulky particles are eliminated by a centrifugal separation process. Further, the pigment dispersion liquid is pressure-filtered by a cellulose acetate filter (made by Advantech) having a pore size of 3.0 μm to obtain a pigment dispersion liquid 4 having a pigment concentration of 10% by weight.

(Preparation of Colored Ink and Image Improving Liquid)

FIG. 7 is a diagram showing concentrations of the pigment dispersion liquid and the resin water solutions B and C at the time of refining seven kinds of colored pigment inks and two kinds of image improving liquids. At preparation, the respective components are mixed according to FIG. 7, which is stirred sufficiently, and thereafter, is pressure-filtered by a cellulose acetate filter (made by Advantech) having a pore size of 8.0 μm to prepare the respective color inks and the image improving liquids CL1 and CL2. The image improving liquid CL1 has a mixing ratio of 1:2 between the resin water solution B being more penetrative and the resin water solution C being less penetrative. On the other hand, the image improving liquid CL2 has a mixing ratio of 2:1 between the resin water solution B being more penetrative and the resin water solution C being less penetrative. Therefore, comparing CL1 and CL2, CL2 is the image improving liquid being more penetrative.

Figure 8:
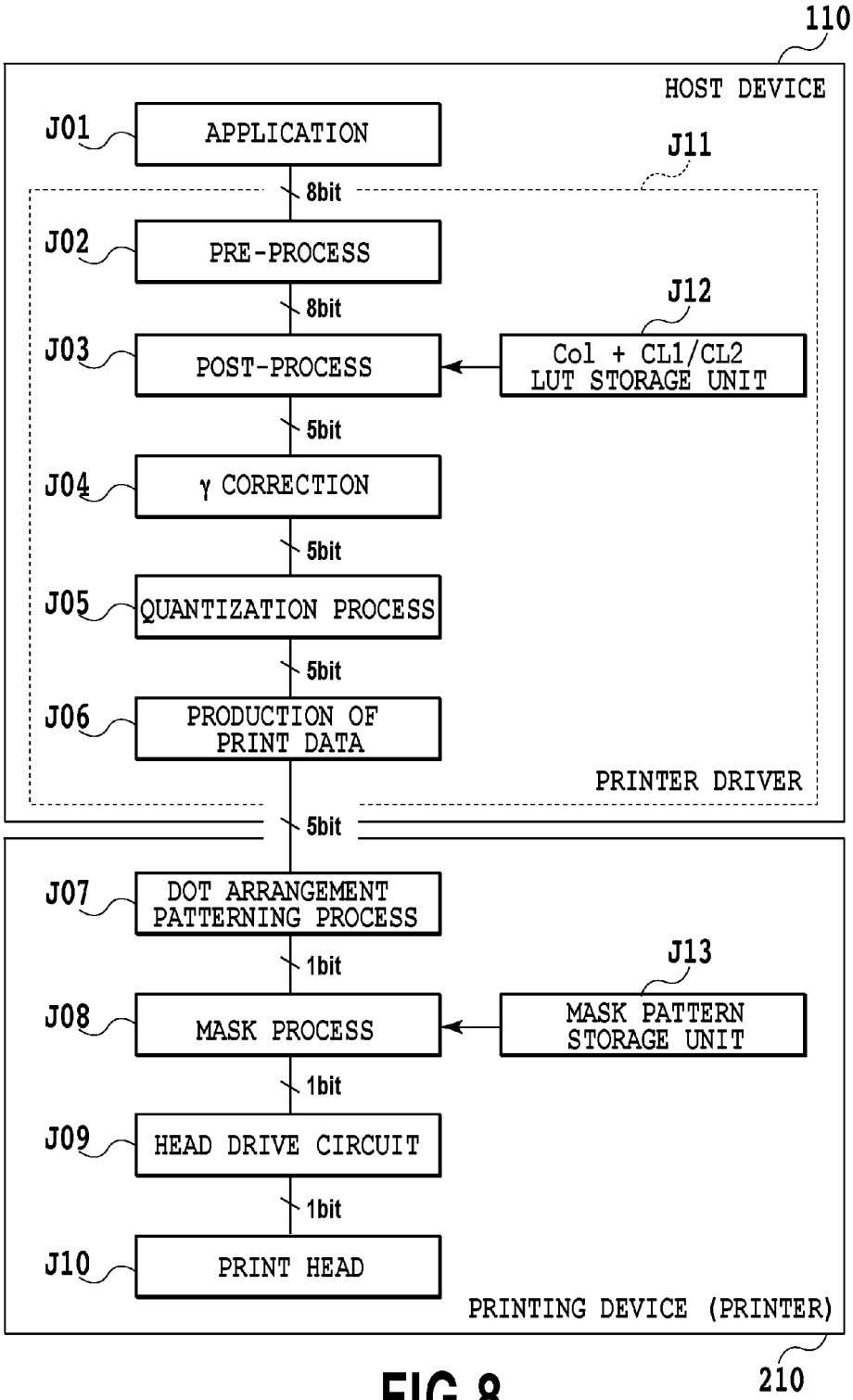
FIG. 8 is a block diagram explaining a system for executing an image process.

FIG. 8 is a block diagram explaining the inkjet printing apparatus for executing the image process in the present embodiment. The inkjet printing apparatus in the present embodiment is constructed of the host device 110 and the printing apparatus (printer) 210.

The host device 110 is, for example, a personal computer (PC), and is constructed of an application J01 and a printer driver J11 for the printing apparatus in the present embodiment. The application J01 executes the process of producing image data to be transmitted to the printer driver J11 and the process of setting print control information for managing control of a print, based upon information indicated on an UI screen in a monitor of the host device 110 by a user.

Figure 9:
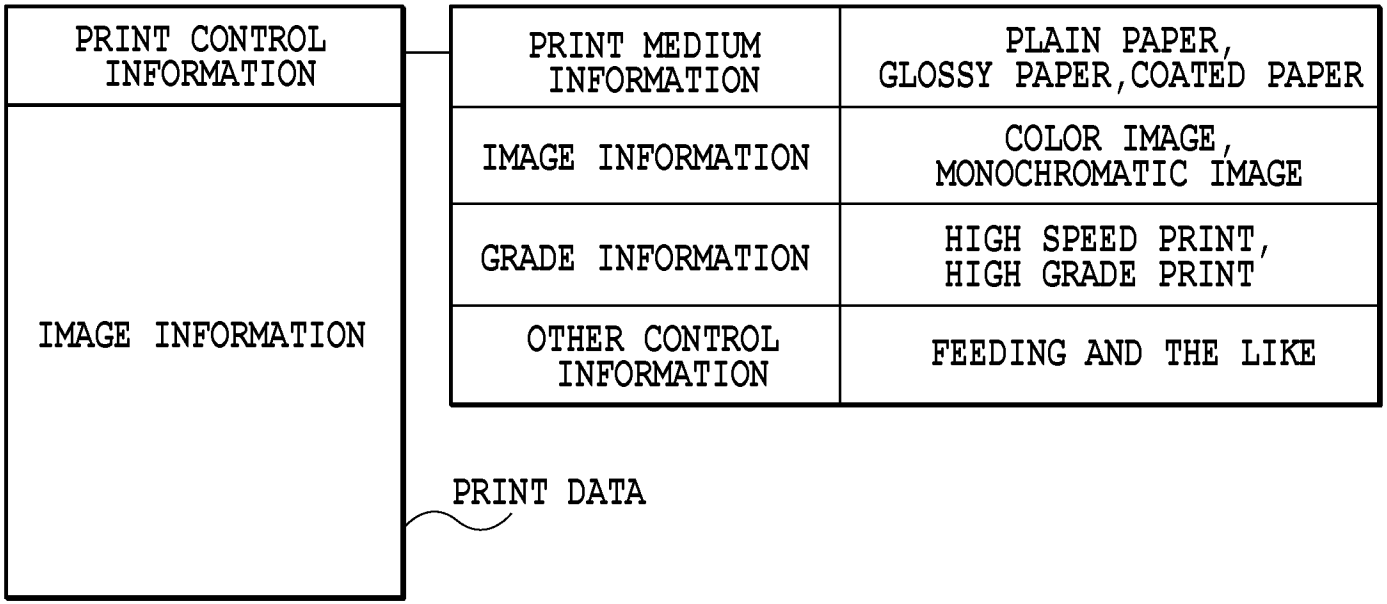
FIG. 9 is a diagram showing a construction example of image data information and print control information.

FIG. 9 is a diagram showing the construction example of image data information and print control information supplied to the printer driver J11 by the application J01. The print control information is constructed of "print medium information", "image information", "print grade information", and "other control information" such as a feeding method. The print medium information stores therein the kind of the print medium as a print target and defines the print medium which is any one kind of a plain paper, a glossy paper, a post card, a printable disc and the like. "Image information" is information expressing the feature of the image, such as "color mode" and "monochromatic mode". The print grade information indicates grades of a print and stores therein any one kind of print grades composed of "fine", "standard", "quick" and the like.

FIG. 8 is again referred to. The printer driver J11 includes a pre-process J02, a post-process J03, γ correction J04, quantization J05, and print data production J06 as the processes. Hereinafter, the respective processes will be briefly explained.

The pre-process J02 executes mapping of a color region (Gamut). This process executes data exchange for imaging a color region reproduced by image data (R, G, B) of an sRGB standard within a color region reproduced by a printer. Specially data of 256 gradations of R, G and B each expressed by 8 bits is converted into R, G and B data (RGB values) of 8 bits each having a different color region by using a three-dimensional LUT (lookup table).

The post-process J03 converts the R G and B data subjected to the mapping process of the color region into a combination of the colored ink reproducing a color expressed by this data and the image improving liquid, based upon the three-dimensional LUT for post-process. Specially by referring to the three-dimensional LUT for post-process, the RGB data of 8 bits is converted into color separation data C, M, Y, K, LC, LM, Gy, CL1, and CL2. In the present embodiment, a plurality of the three-dimensional LUTs for post-process are stored in an LUT storage unit J12 for post-process, and an appropriate table is selected based upon the kind of the print medium of the print control information and the image information. Both in the pre-process and the post-process, data not adapted for lattice points in the table may be converted by use of interpolation calculation together therewith.

The γ correction J04 executes a density value (gradation value) conversion in regard to color separation data of each color found by the post-process J03. Specially the primary dimensional LUT is used to convert color separation data of 8 bits into 8 bit data so as to be linearly associated with gradation characteristics of a printer.

The quantization unit J05 executes the quantization process of converting each of the color separation data of 8 bits for each color subjected to the γ correction into data of 5 bits. In the present embodiment, 8-bit data of 256 gradations is converted into 5-bit data of 17 gradations by using an error diffusion method. The 5-bit print image data is data as an index for showing a dot arrangement pattern in a patterning process in a dot arrangement in the printing apparatus. It should be noted that the data in which each color is quantized to 17 gradations shows gradation value information showing any gradation of levels 0 to 16. The image processes of the pre-process J02 to the quantization process J05 described above all are executed at the resolution of 300 ppi (pixel/inch).

The print data producing process J06 combines the aforementioned print control information and image data information constructed of the 5-bit data produced by the quantization unit J05, and outputs the combined information to the printing apparatus 210 together with the aforementioned print control information.

The print apparatus 210 having receiving the above information, firstly executes the dot arrangement patterning process to the image data of 300 ppi. In the dot arrangement patterning process J07, the inputted gradation value information of 17 gradations is converted into the dot arrangement pattern shown in binary values of printing or non-printing of the dot. In consequence, the 5-bit image data of 300 ppi is converted into one-bit data of 1200 dpi (dot/inch), and binary data on whether or not the print head ejects inks to the individual pixel is determined.

Figure 10:
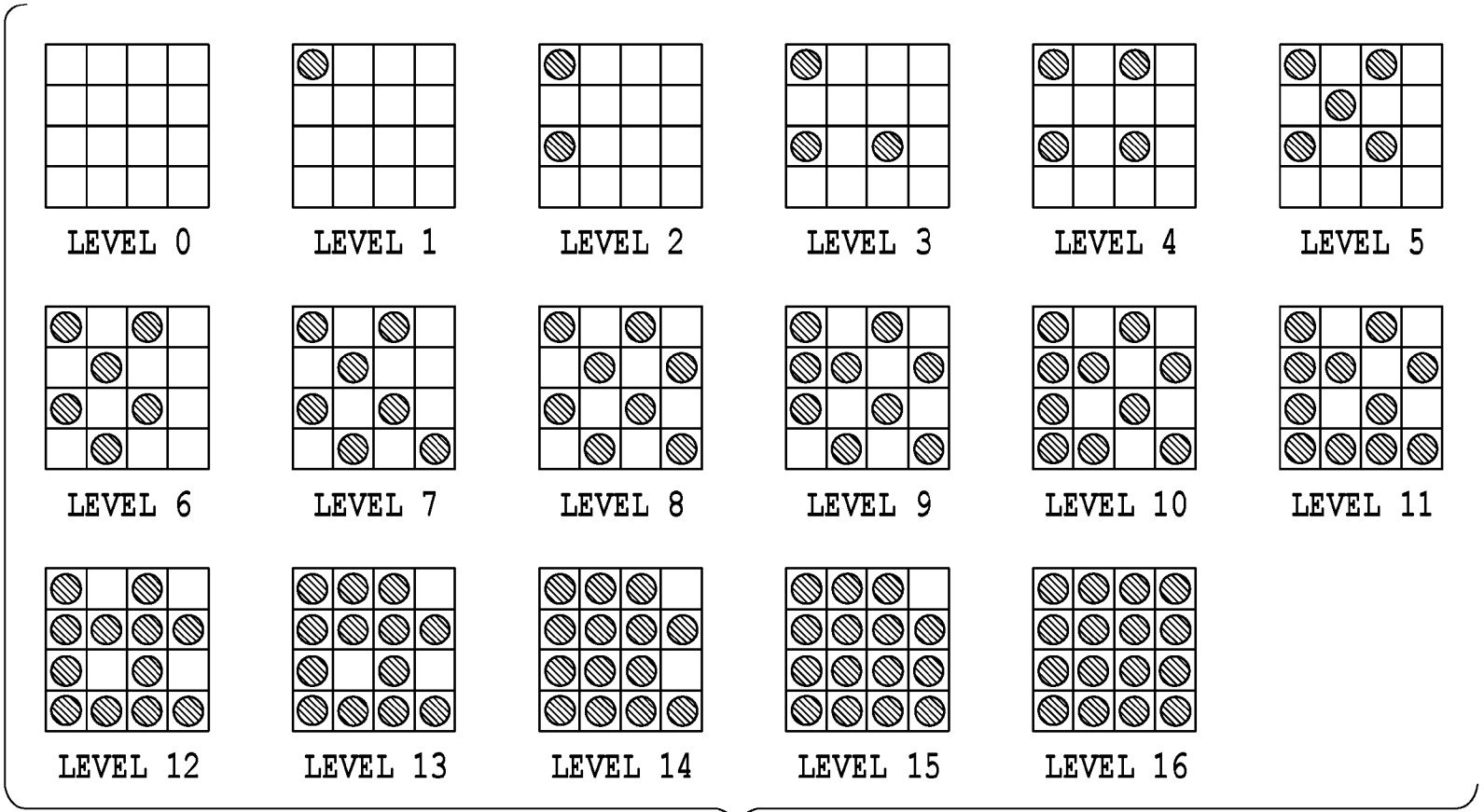
FIG. 10 is a diagram showing a dot arrangement pattern of 17 gradations used in the embodiment.

FIG. 10 is diagrams showing dot arrangement patterns of 17 gradations used in the present embodiment. Each level shows a value of 1 to 16 inputted to the dot arrangement patterning process, and areas of 4×4 show a region of 4 pixels×4 pixels of 1200 dpi corresponding to one pixel region of 300 dpi. In the figure, the area in which a circle is shown shows a pixel printing a dot, and the area in which a circle is not shown shows a pixel not printing a dot. It is found that as the level value increases, the numbers of the areas printing the dot also increase.

In the subsequent mask process J08, by using mask patterns having a completing relationship with each other, to a dot of each color in which the print is determined by the dot arrangement patterning process J07, a scan by which the dot is printed in a multi-pass print is determined.

Figure 11A:
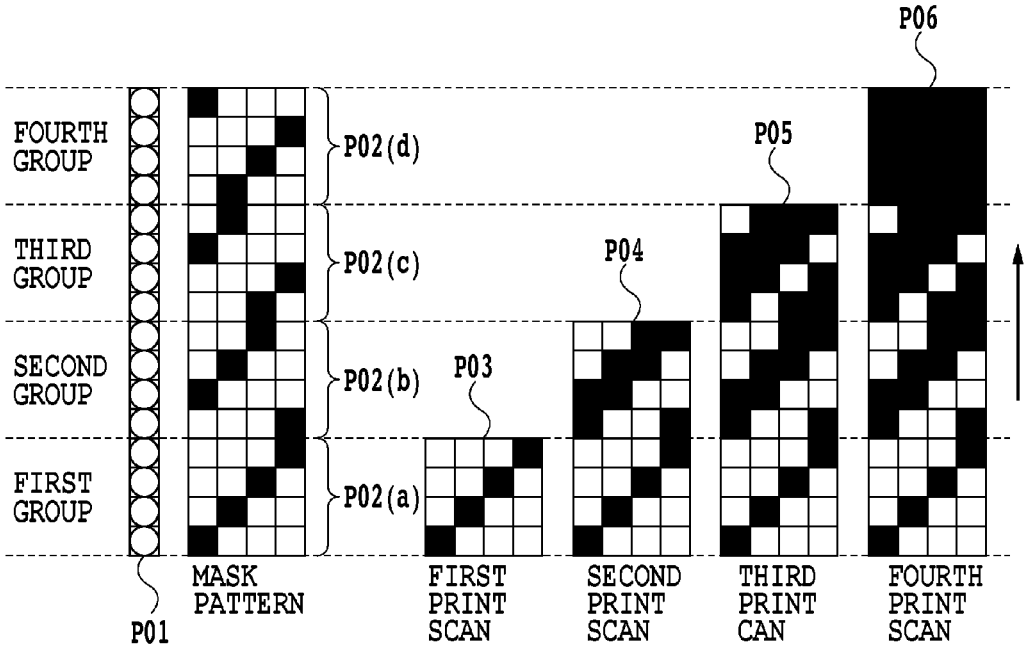
FIGS. 11A and 11B are diagrams each explaining a multi-pass print.
Figure 11B:
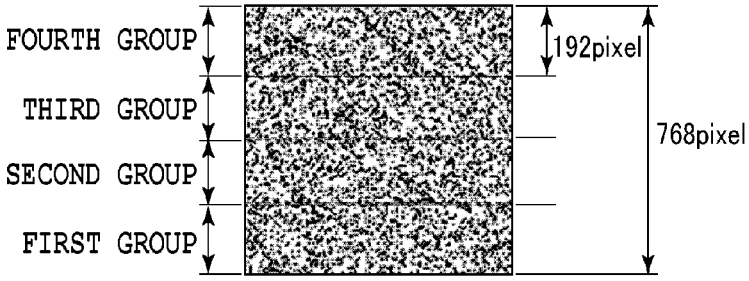

FIGS. 11A and 11B are diagrams specially explaining the above multi-pass print and the mask patterns. In the multi-pass print, a plurality of the times of main scans by the print head are performed to the same image region of the print medium by interposing a conveyance movement shorter that a print width of the print head between the scans, thus printing an image on the print medium. FIG. 11A shows a printing state of the mask pattern and each scan in a case of performing a multi-pass print of a four-pass. In a case of the multi-pass print of the four-pass, a nozzle line P01 may be assumed to be divided into four groups. For simple understanding, since the nozzle line in which 16 ejection openings are arranged is shown, the number of the nozzles included in each group is four. The region shown by 4 areas×4 areas shown by each of P02 (*a*) to P02 (*d*) is a mask pattern allotted to each group, wherein a black area shows that a print of the pixel is allowed and a white area shows that the print of the pixel is not allowed.

On the other hand, P03 to P06 show the process where the image is being printed by repeating the print scan using the mask patterns P02 (*a*) to P02 (*d*) and the conveyance movement corresponding to four pixels Since the mask patterns P02 (*a*) to P02 (*d*) have a complementary relationship with each other, by repeating the print scan using these mask patterns and the conveyance movement of the four pixels each, an image on the same image region of the print medium is completed by four times of the print main scans.

In FIG. 11A, for simplification, the nozzle line having 16 nozzles is explained, but as in the case of the present embodiment, in a case where one nozzle line has 768 nozzles, the mask pattern includes a larger region. FIG. 11B shows an example of mask patterns for four-pass corresponding to the nozzle line having 768 nozzles. In a case where the nozzle line has 768 nozzles, each group has 192 nozzles, and one time of the conveyance amount of the print medium corresponds to 192 pixels.

The mask pattern described above may be a mask pattern different for each color or may differ depending on the kind of the print medium or the like. A plurality of mask patterns are stored in the mask pattern storage unit J13 of the present embodiment, and an appropriate mask pattern can be selected based upon the kind of the print medium, the image information, the print grade information, and the like of the print control information. It should be noted that if the print to be performed according to the print control information is a one-pass print, the mask pattern is not used and the mask process J08 is not executed.

The print data of each scan produced by the mask process J08 is supplied to a head drive circuit J09 in an appropriate timing, which is converted into a drive pulse of the print head 1, and, based upon the drive pulse, ink is ejected in a predetermined timing from the print head of each color.

Hereinafter, the featuring construction of the present invention will be explained. In the present embodiment, a ratio in use of two kinds of image improving liquids differs depending on the printing mode, specially depending on the color mode or the monochromatic mode. Here, first, the permeation characteristics of the two image improving liquids CL1 and CL2 to the print medium will be explained. As already explained, the image improving liquid CL1 contains the resin water solution C having low penetratability more than the resin water solution B having high penetratability. On the other hand, the mage enhancement solution CL2 contains the resin water solution B having high penetratability more than the resin water solution C having low penetratability. Therefore, comparing CL1 and CL2, CL2 is the image improving liquid having the higher penetratability.

Figure 12A:
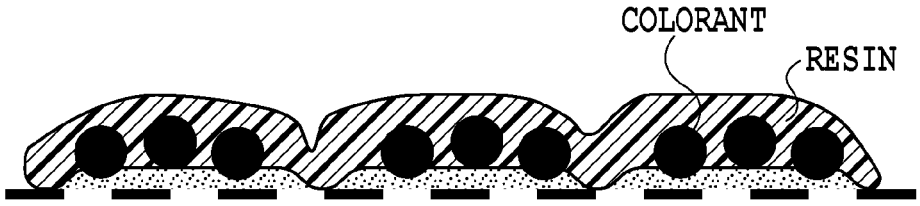
FIGS. 12A and 12B are diagrams explaining a difference in penetrate of an image improving liquid.
Figure 12B:
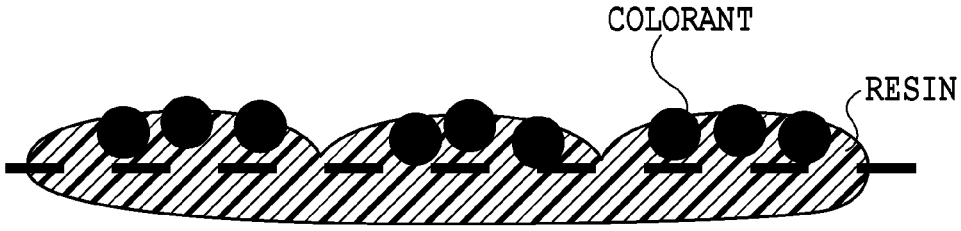

FIGS. 12A and 12B are schematic diagrams explaining a difference in penetratability between the image improving liquids CL1 and CL2 in a case where CL1 and CL2 are applied on the print medium in which the print is performed by the pigment ink. In the image improving liquid CL1 having the low penetratability, the liquid component and the solid component are easy to be separated. That is, the resin as the solid component is difficult to permeate into the print medium in the depth direction and easy to remain on the surface layer (FIG. 12A). As a result, in a case of performing a print on a glossy paper originally having high smoothness, the thin film interference is restricted but the image clarity is deteriorated by generation of concavity and convexity. On the other hand, a ratio in which surfaces of the colorant are coated with the resin having high residual characteristics is high, and the bronze is difficult to generate.

In contrast, in the image improving liquid CL2 having the high penetratability, the liquid component and the solid component are difficult to be separated. That is, the resin as the solid component is easy to permeate into the print medium in the depth direction and difficult to remain on the surface layer (FIG. 12B). As a result, even in a case of performing a print on a glossy paper originally having high smoothness, the image clarity is maintained without generation of new concavity and convexity. However, since the remaining resin layer is a thin film and the colorant is also not sufficiently coated, a reduction effect of the thin film interference or the bronze is not as large as in the image improving liquid CL1. In the present embodiment, as described above, there are prepared the two image improving liquids of the image improving liquid CL1 in which the coloring reduction effect is high but the concern on the image clarity deterioration is high and the image improving liquid CL2 in which the coloring reduction effect is low but the concern on the image clarity deterioration is low.

Figure 16A:
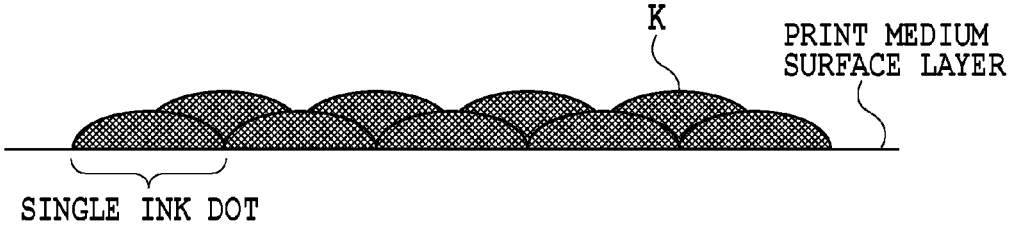
FIGS. 16A and 16B are diagrams each showing a laminate state of pigments.
Figure 16B:
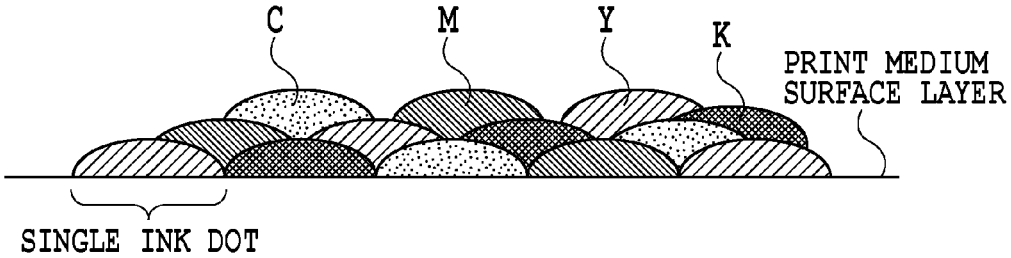

Next, the degree in each of the image clarity and the coloring due to the thin film interference or the bronze required in each of the color mode and the monochromatic mode will be considered. In general, since inks of various colors are used in the color mode, many pigments are easy to be exposed and laminated as shown in FIG. 16B. As a result, in a region from intermediate gradation to high density for printing many inks, the bronze tends to be easily generated. On the other hand, in the color mode, it is required to print an image photographed by a digital camera or the like in such a manner as to have some high image clarity, but in a state where the concavity and convexity are formed by many pigment particles, it is not desirable to deteriorate the image clarity furthermore.

On the other hand, in the monochromatic mode using achromatic inks (black ink and gray ink) only, the thin film interference tends to be easily generated and a slight color deviation of the gray tone tends to be easily noticeable on an image. On the other hand, since the number of the kinds of inks in use is small, the concavity and the convexity due to the laminate of the colorants as shown in FIG. 16A are small, and the image clarity is maintained in a high grade.

As described above, in the present embodiment, the color mode has an object of mainly reducing the bronze without furthermore deteriorating the image clarity. On the other hand, the monochromatic mode has an object of reducing the color deviation due to the thin film interference.

Therefore, in the present embodiment, in regard to the color mode, more image improving liquid CL2 having high penetratability is used for not deteriorating the image clarity, and in regard to the monochromatic mode, more image improving liquid CL1 is used for restricting the thin film interference more actively. Such a print can be realized by featuring the table used in the post-process J03.

Figure 13:
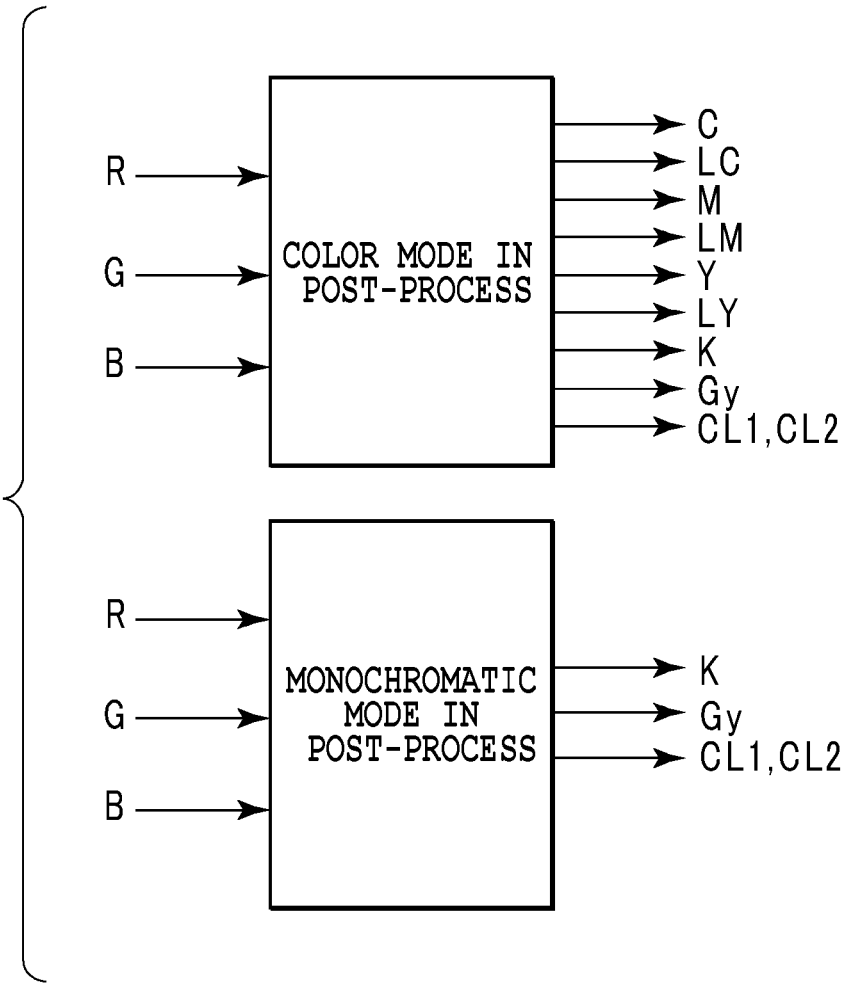
FIG. 13 is a diagram showing a conversion state of signal values in a post-process.

FIG. 13 is diagrams each showing a conversion state of signal values in each of the color mode and the monochromatic mode in the post-process J03. In the color mode, RGB signals of 256 values of 8 bits are converted into signals of C, M, Y, K, LC, LM, Gy, CL1 and C2 of 256 values of 8 bits. Then, a post-table in the present embodiment is produced in such a manner that in regard to colored inks of seven colors, a balance of mutual signal values is changed by the input signals RGB, but in regard to CL1 and CL2, a signal value of CL2 is always larger than a signal value of CL1. On the other hand, in the monochromatic mode, RGB signals of 256 values of 8 bits are converted into signals of K, Gy, CL1 and C2 of 256 values of 8 bits. Then, a post-table in the present embodiment is produced in such a manner that in regard to black K and gray Gy, a balance of mutual signal values is changed by the input signals RGB, but in regard to CL1 and CL2, a signal value of CL1 is always larger than a signal value of CL2.

Figure 14A:
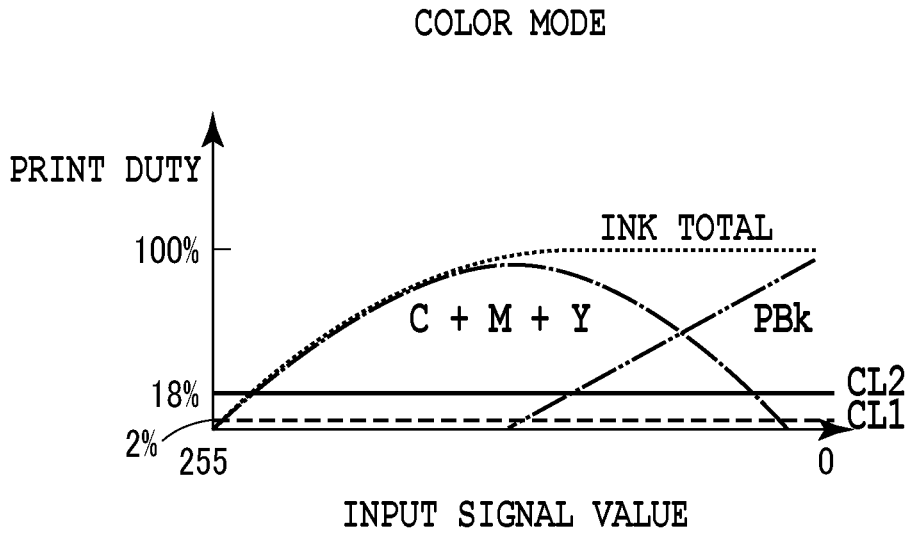
FIGS. 14A and 14B are diagrams each showing a relation of print duties of colored inks and image improving liquids to an input signal.
Figure 14B:
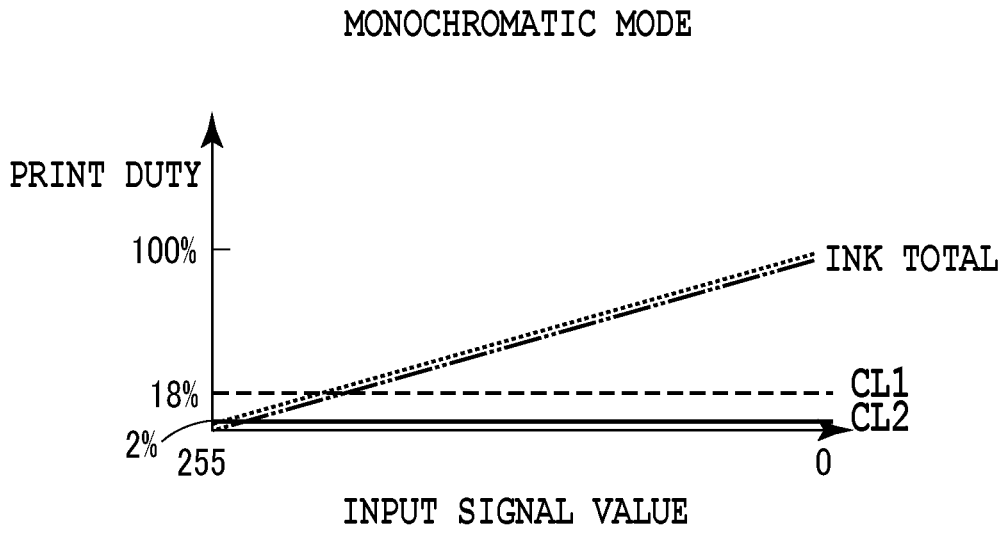

FIGS. 14A and 14B are diagrams each showing a relation of print duties of colored inks and two Image improving liquids to input signals (RGB) in the color mode and the monochromatic mode. In the figure, a lateral axis expresses input signals of achromatic colors from white (R=G=B=255) to black (R=G=B=0). In addition, a vertical axis expresses print duties in the print medium as a result printed according to output signals converted from the input signals in the post-process J03. Here, the print duty show a ratio of pixels in which one dot is printed among all pixels arranged in 1200 dpi. Therefore, for example, in a state of printing one dot on each of all the pixels, the print duty amounts to 100%.

FIG. 14A shows a color mode. Here, a sum (sum of C, LC, M, LM, and Y) of print duties of chromatic inks and a sum (sum of K and Gy) PBk of print duties of achromatic inks are shown. In a region from a highlight (R=G=B=255) to an intermediate gradation (R=G=B=128) in the color mode, an achromatic color (gray tone) is expressed by mixing of chromatic inks, and a sum PBk of the achromatic inks remains to be zero. PBk is gradually increased from the substantially intermediate gradation and CMY is decreased followed by it. In the high density region, a relation between PBk and CMY is reversed, wherein in the high density region (R=G=B=0), PBk amounts to 100% and CMY amounts to 0%. On the other hand, FIG. 14B shows a state of signal value conversion in the monochromatic mode. In the monochromatic mode, a value of PBk linearly increases from a highlight portion to a high density region through an intermediate gradation (R=G=B=128).

Both figures show a sum (Ink total) of the chromatic inks CMY and the achromatic inks PBk to each input signal. The Ink total has a correlation with an amount of pigments remaining on the surface of the print medium as shown in each of FIGS. 16A and 16B. Comparing FIGS. 14A and 14B, it is found that a value of the Ink total in any input signal in the color mode using many chromatic inks is larger than that in the monochromatic mode using achromatic inks only, and an amount of the pigments remaining on the surface of the print medium in the color mode is also more than that in the monochromatic mode.

Next, the print duty of each of the image improving liquids CL1 and CL2 will be explained. In the present embodiment, in each of the color mode and the monochromatic mode, a constant amount of the image improving liquid is always printed on the print medium regardless of the value of the input signal. At this time, in the color mode, the print duty of CL1 is set to 2% to any of the input signals (0 to 255), and the print duty of CL2 is set to 18% thereto. On the other hand, in the monochromatic mode, the print duty of CL1 is set to 18% to any of the input signals (0 to 255), and the print duty of CL2 is set to 2% thereto.

In this manner, in the present embodiment, each of the two kinds of the image improving liquids CL1 and CL2 is printed in a constant print duty at all the gradations both in the color mode and the monochromatic mode. In addition, in the color mode, the used amount of CL2 with respect to a total amount of the colored inks is larger than used amount of CL1 with respect to the total amount of the colored inks, but in the monochromatic mode, the above relation is reversed.

Figure 17A:
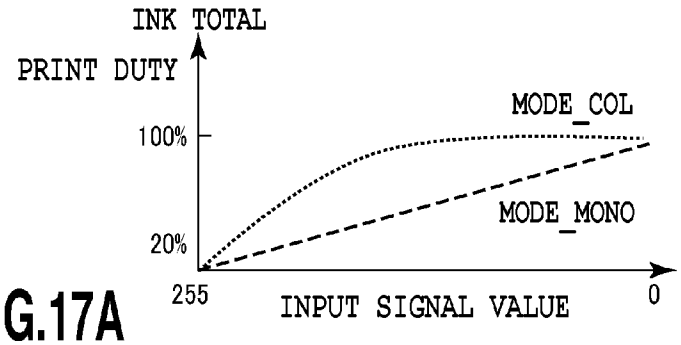
FIGS. 17A to 17E are diagrams for explaining a reduction effect of coloring of reflected light.
Figure 17B:
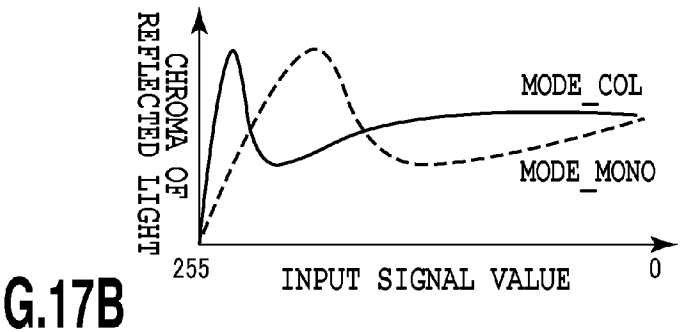
Figure 17C:
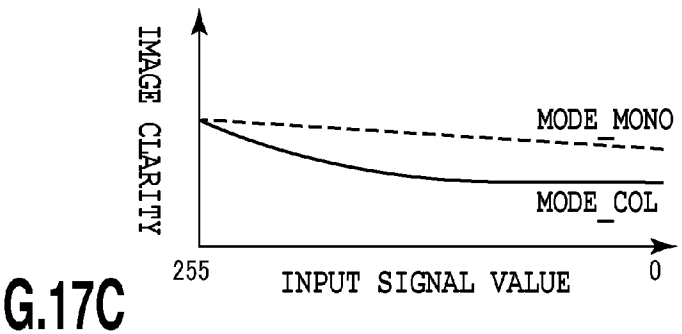

FIGS. 17A to 17C are diagrams explaining a reduction effect in the coloring of reflected light together with the image clarity in a case of adopting the present embodiment. First, FIG. 17A is a diagram showing a total print duty of colored inks on the print medium to an input signal of an achromatic color in a case of performing a print on a glossy paper. This results in showing Ink total of each of FIGS. 14A and 14B in the same graph. As seen from the figure, a value of the total print duty in the color mode using many kinds of colored inks is larger in a region of all the gradations than in the monochromatic mode using a few kinds of inks.

FIG. 17B is a diagram showing a degree of chroma (coloring) of reflected light to an input signal of an achromatic color in a case of not applying the image improving liquid, which is different from the present embodiment. In the color mode, since a laminated layer of the pigment is exposed as shown in FIG. 16B in a wide region over an intermediate gradation, coloring (bronze) of the regular reflected light is noticeable. The coloring due to thin film interference remains in a highlight region where an ink amount to be printed is extremely small. On the other hand, in the monochromatic mode, since the laminated layer of the pigment is small as shown in FIG. 16A, a region where the bronze is noticeable is limited to only a high density region, but the coloring due to the thin film interference tends to be easily noticeable in a wide region from the highlight region to the intermediate gradation region.

On the other hand, FIG. 17C is a diagram showing a degree of image clarity in each of the color mode and the monochromatic mode in a case of not applying the image improving liquid, which is different from present embodiment. In the color mode, a laminated layer of the pigment is exposed as shown in FIG. 16B in a wide region over an intermediate gradation, concavity and convexity appear on the print surface, and the image clarity is already deteriorated on some level as compared to a glossy paper of white. On the other hand, in the monochromatic mode, since the laminated layer of the pigment is small as shown in FIG. 16A, high image clarity of the glossy paper of white is substantially maintained.

In a case of not printing the image improving liquid in this manner, there occurs a problem of coloring mainly due to bronze in the color mode, and in the monochromatic mode, the image clarity is high, but there occurs a problem of coloring due to thin film interference. Therefore, in the present embodiment, the coloring due to the bronze or the thin film interference is reduced by applying the image improving liquid. However, in this case, the minimum limit is defined in regard to the image clarity, which prevents the image clarity from being furthermore deteriorated therefrom. Specially the degree in the vicinity of a value of the image clarity in the color mode in a state where the image improving liquid is not applied is defined as the minimum limit of the image clarity in the present embodiment. In addition, an appropriate amount of each of the image improving liquids CL1 and CL2 is applied in such a manner that, while maintaining the minimum limit of the image clarity, in the color mode the coloring due to the bronze is reduced, and in the monochromatic mode the coloring due to the thin film interference is reduced. Therefore, in the color mode in which the image clarity is already in the vicinity of the minimum limit, many image improving liquids CL2 having high penetratability (difficult to form a layer) are applied to reduce the bronze without deteriorating the image clarity. On the other hand, in the monochromatic mode, many image improving liquids CL1 having low penetratability (easy to form a layer) are applied, and thereby the image quality is deteriorated in some degree, but the coloring due to the thin film interference is more actively reduced.

Figure 17D:
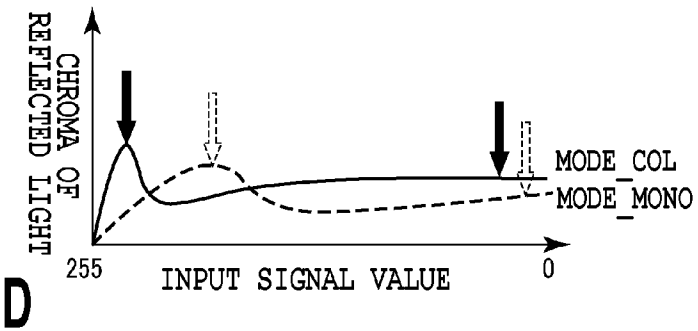

FIG. 17D is a diagram showing a degree of chroma (coloring) of reflected light to an input signal of an achromatic color in a case of applying the image improving liquid as in the case of the present embodiment. As in the case of the present embodiment, applying a constant amount of the image improving liquid to all input signal values, the coloring of regular reflected light is restricted as a whole both in the color mode and in the monochromatic mode. In the color mode, the coloring of the regular reflected light is reduced in a wide region from an intermediate gradation to a high density region by a print of CL2. The restriction effect of the regular reflected light by CL2 is smaller than that by CL1, but as compared to FIG. 17B where the image improving liquid is not applied, an application of CL2 effectively reduces the bronze in a wide gradation region. In FIG. 17B, the gradation region of the achromatic color is shown, but the similar effect can be obtained also in a region of the chromatic color.

Figure 18:
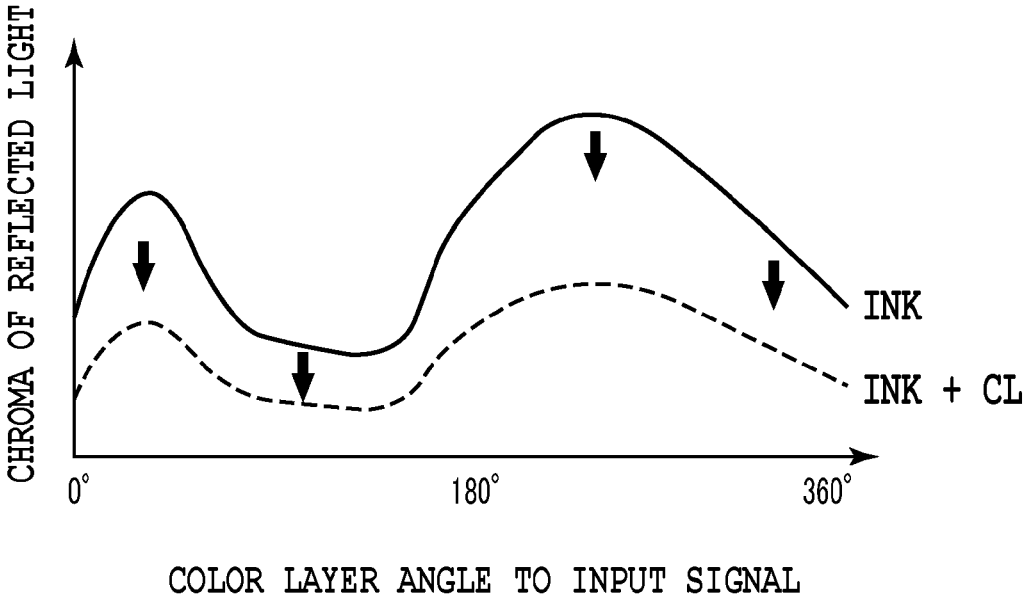
FIG. 18 is a diagram showing a reduction effect of coloring of reflected light in every hue.

FIG. 18 is a diagram for comparing chroma of reflected light in which a color deviation to a hue angle in a color image is generated, between a case of not applying the image improving liquid and a case of applying the image improving liquid according to the present embodiment. It is found that in any hue, the chroma of the reflected light in the present embodiment where the image improving liquid is applied is reduced more than in a case of not applying the image improving liquid.

FIG. 17D is referred back to. In the monochromatic mode, the coloring of the regular reflected light due to the thin film interference is largely reduced in a wide region from a highlight region to an intermediate gradation by a print of CL1 having a higher restriction effect of the regular reflected light.

Figure 17E:
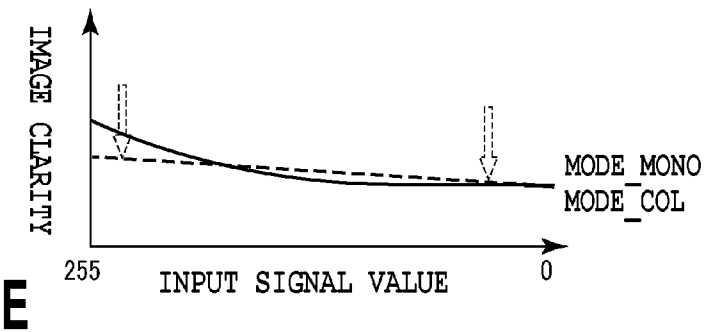

On the other hand, FIG. 17E is a diagram showing a degree of image clarity to an input signal of an achromatic color in a case of applying the image improving liquid as in the case of the present embodiment. In the color mode, a reduction of the image clarity is nearly not made by using the image improving liquid CL2 having high penetratability. That is, the image clarity of the color mode is maintained not to be lower than the minimum limit. In the monochromatic mode, a new layer is formed on the print medium surface by using the image improving liquid CL1 having low penetratability, and the image clarity is deteriorated. However, the deterioration degree is maintained not to be lower than the minimum limit as similar to the color mode.

According to the present embodiment in this manner, an appropriate image improving liquid is applied by an appropriate amount to each of the color mode and the monochromatic mode, and thereby each of the coloring of the regular reflected light and the image clarity can be controlled within an allowable range.

It should be noted that the application amount (print duty) of each of CL1 and CL2 as explained above is preferably adjusted also by the kind of the glossy paper to be printed.

FIG. 15 is a diagram showing an example where a print duty of CL1 and a print duty of CL2 are made different from each other corresponding to the kind of the glossy paper. Here, print duties of CL1 and CL2 to each of three kinds of glossy papers (glossy paper A, glossy paper B, and glossy paper C) are shown in the color mode and in the monochromatic mode. The glossy paper shown in FIGS. 14A and 14B corresponds to glossy paper A in FIG. 15. In general, even in the same glossy paper, the hue or the chroma expressed by the same ink differs depending on the kind of the glossy paper, and the image clarity and the coloring of the reflected light or a degree of the bronze also differ. Therefore, in the present embodiment, the print duty of each of the image improving liquids CL1 and CL2 is adjusted corresponding to the kind of the glossy paper.

However, as seen from FIG. 15, a ratio of CL1 to CL2 (CL1/CL2) in the monochromatic mode is higher than in the color mode in any glossy paper. This is because all the glossy papers are in greater or lesser degrees in agreement in regard to a point where in the color mode in which it is desired to avoid deterioration of the image clarity, many image improving liquids CL2 are used, and in the monochromatic mode in which it is desired to actively restrict the color deviation of the reflected light or the bronze, many image improving liquids CL1 are used. It should be noted that in the above embodiment, the ratio of the image improving liquids in use differs between the color mode and the monochromatic mode, but, for example, the embodiment may be constructed in such a manner that the image improving liquid CL2 only is printed in the color mode and the image improving liquid CL1 only is printed in the monochromatic mode.

As described above, it is preferable to appropriately adjust the amount of the image improving liquid to be printed in accordance with the kind of the print medium or the printing mode. However, each of the print mediums also has the upper limit over which the liquid can not be accepted. That is, when the image improving liquids are printed by so many amounts, there occurs the concern that a printable amount of the pigment inks is limited to narrow a color reproduction range. Taking it into account, a sum of print duties of the image improving liquid to be applied to the print medium is preferably 15% to 30% of a sum of print duties of the pigment ink. In an example of glossy paper A, a sum of the print duties of the image improving liquids is 20%=2+18, and a maximum sum (Ink total) of print duties of the pigment ink is 100%. That is, the sum of the print duties of the image improving liquids is included within 15% to 30% of the maximum value of the print duty sum of the pigment ink.

(Second Embodiment)

Also in the present embodiment, the inkjet printing apparatus, the pigment ink and the image improving liquid as similar to those in the first embodiment are used. In the present embodiment, however, in the color mode, the image improving liquid CL2 only is used and the image improving liquid CL1 is not used. In addition, in the monochromatic mode, the image improving liquid CL1 only is used and the image improving liquid CL2 is not used. An application amount of the image improving liquids in these modes is changed in accordance with a total amount of the pigment inks.

FIGS. 19A to 19D are diagrams each showing a relation between input signals (RGB) and print duties of pigment inks and image improving liquids. The print duty of the image improving liquid is fixed to 20% from a white region (R=G=B=255) to a highlight region in the color mode and from a white region (R=G=B=255) to an intermediate gradation region in the monochromatic mode. In other regions, both in the color mode and in the monochromatic mode, the print duty of the image improving liquid is changed in such a manner as to be actually 20% of a total print duty (Ink total) of the pigment inks to be printed on the print medium. By thus adjusting the total print duty of the pigment inks in accordance with the gradation, it can be prevented to consume the image improving liquid more than necessary or to deteriorate the image clarity more than necessary.

Figure 19A:
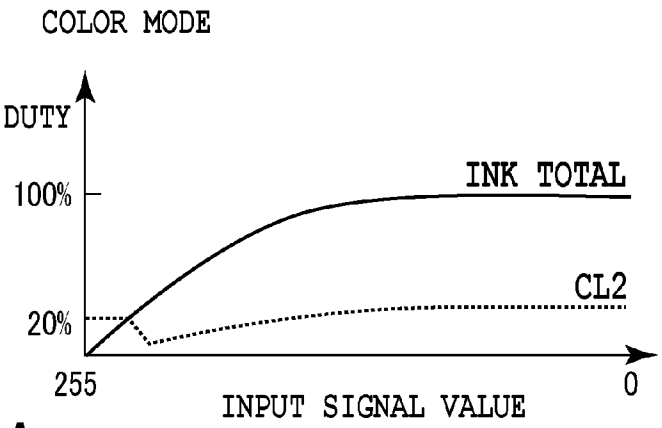
FIGS. 19A to 19D are diagrams each showing a relation between an input signal and a print duty in a second embodiment.
Figure 19B:
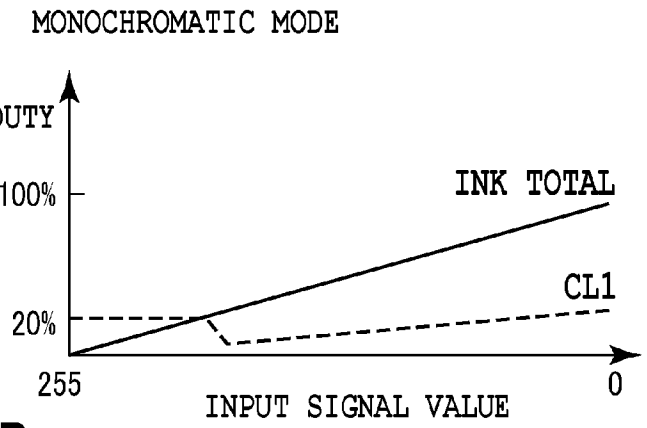
Figure 19C:
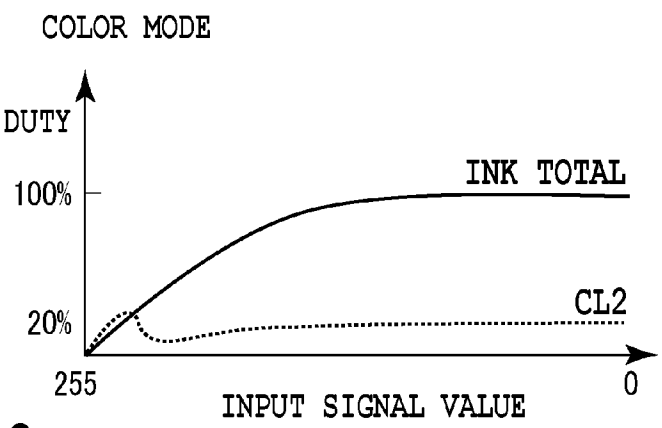
Figure 19D:
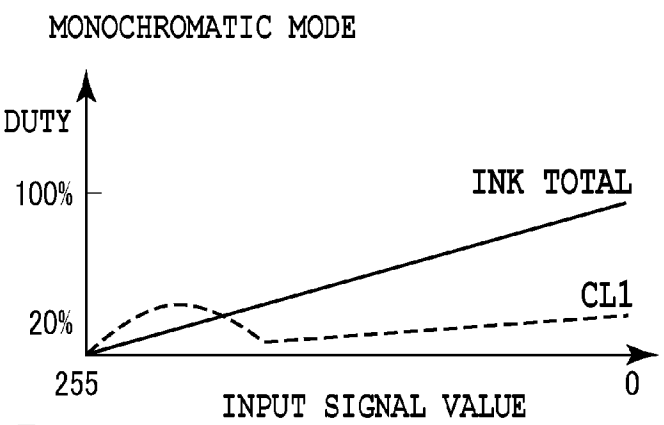

It should be noted that as in the case of a semi-glossy paper, there are some print mediums where the thin film interference is not so much noticeable depending on the kind of the print medium. In such a case, as shown in FIGS. 19C and 19D, the print duty of the image improving liquid in white (R=G=B=255) may be constructed to be zero.

(Third Embodiment)

Also in the present embodiment, the inkjet printing apparatus, the pigment ink and the image improving liquid as similar to those in the first embodiment are used. In the monochromatic mode, as similar to the second embodiment, the print duty is set according to FIG. 19B or 19D. However, in the present embodiment, for actively restricting the thin film interference in the highlight region in the color mode, the image improving liquid CL1 having low penetratability is applied more than the image improving liquid CL2 in the highlight portion.

Figure 20A:
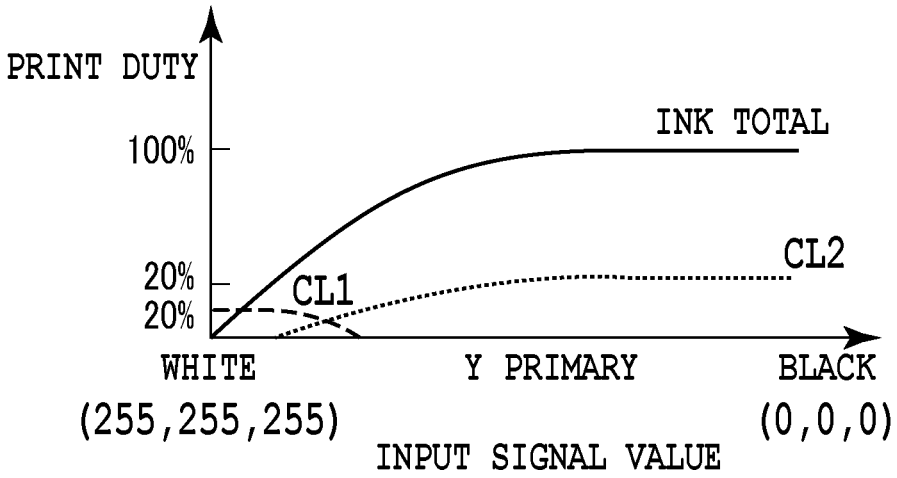
FIGS. 20A and 20B are diagrams each showing a relation between an input signal and a print duty in a third embodiment.
Figure 20B:
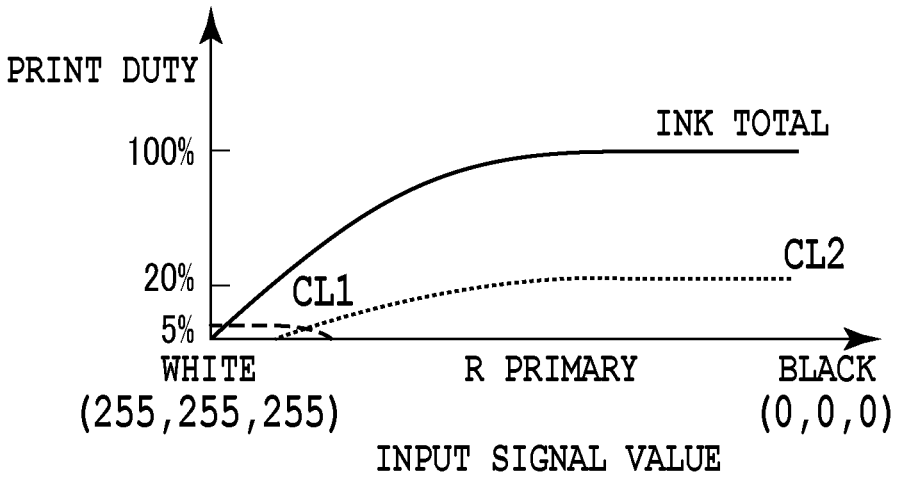

FIGS. 20A and 20B are diagrams each showing a relation between input signals (RGB) and print duties of colored inks and image improving liquids. Here, FIG. 20A shows input signals in the process of advancing from white (R=G=B=255) via Y primary (R=G=255, B=0) toward black (R=G=B=0). FIG. 20B shows input signals in the process of advancing from white (R=G=B=255) via R primary (R=255, G=B=0) toward black (R=G=B=0). In any of the figures, the image improving liquid CL1 is actively used in the vicinity of the highlight and the print duty of the image improving liquid CL2 is set to 0%. In a region after the intermediate density, the print duty of the image improving liquid CL1 is set to 0% and the image improving liquid CL2 is actively used. By thus using the image improving liquid CL1 having low penetratability instead of the image improving liquid CL2 having high penetratability only in the highlight region, the coloring due to the thin film interference specific in the highlight portion explained in FIG. 17B can be restricted in pinpoint accuracy.

In addition, in the present embodiment, since a bias in a hue of the reflected light due to such thin film interference exists, the print duty of the image improving liquid CL1 is adjusted also in accordance with the hue of the input signal. To be specially explained, the coloring of the reflected light due to the thin film interference is particularly noticeable in a yellow hue in which a refraction index is high and strength of regular reflected light is high. Therefore, in the present embodiment, an application amount of the image improving liquid CL1 having low penetratability is larger, although in the same highlight, in the highlight particularly in the yellow direction than in the highlight in the other direction. For example, in the highlight region in the yellow direction shown in FIG. 20A, the print duty of the image improving liquid CL1 is 10%, and on the other hand, in the highlight region in the red direction (R direction) shown in FIG. 20B, the print duty of the image improving liquid CL1 is restricted to 5%.

As explained above, in the present embodiment, a total print duty of the image improving liquids (CL1 and CL2) is restricted to 20% or less of a total print duty of the pigment inks, and CL1 is used more than CL2 in the highlight portion. Furthermore, the print duty is set in such a manner that in all the gradation regions, a ratio of CL1 to CL2 is larger in the monochromatic mode than in the color mode. In consequence, the coloring of the reflected light in the highlight portion in the color mode can be effectively restricted and the coloring of the reflected light and the image clarity both can be restricted within an allowable range in any of the printing modes.

(Fourth Embodiment)

Also in the present embodiment, the inkjet printing apparatus, the pigment ink and the image improving liquid as similar to those in the first embodiment are used. However, in the present embodiment, in addition to the seven colors of the pigment inks, a gray ink (LGy) in which the content concentration of pigment black is set to 0.5% is prepared, which is used instead of the image improving liquid CL1. At this time, the gray ink has low penetratability as comparable as that of the image improving liquid CL1.

In this case, in the color mode, CL2 is mainly used as similar to the second embodiment. LGy is used only a region from white to a part of the highlight region, wherein the image clarity is more than a predetermined level and the color reproduction characteristic is difficult to be damaged. In the monochromatic mode, LGy is used to all the input signals except for a white point. In the monochromatic mode, by printing LGy while adjusting the print duty of each of other achromatic inks K and Gy, the coloring of the regular reflected light can be restricted without damaging a gray balance.

It should be noted that in the above embodiment, the image improving liquids CL1 and CL2 or LGy can achieve furthermore the effect of each by over-coating an image by other pigment inks therewith. That is, it is preferable that the image improving liquids CL1 and CL2 or LGy are applied to the print medium on which a print by the pigment ink is completed. For controlling such a print order, for example, the mask pattern in the multi-pass print as described above can be used.

Figures 21A, 21B:
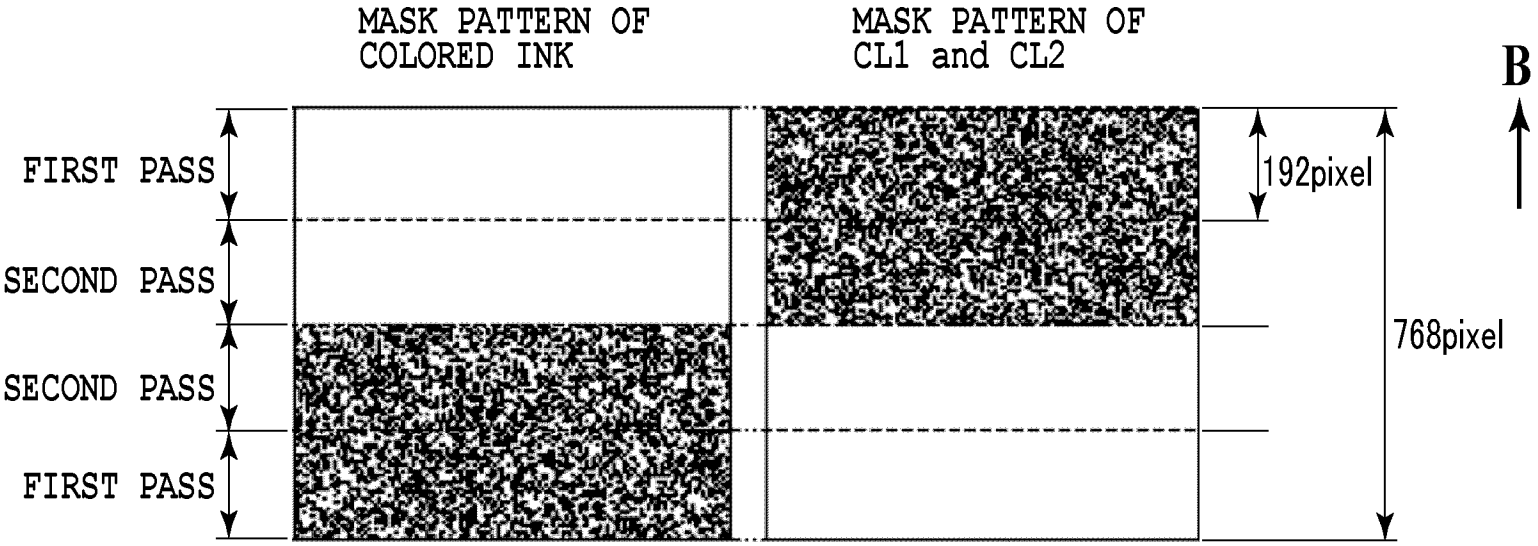
FIGS. 21A and 21B are diagrams each showing a mask pattern usable in the present invention.

FIGS. 21A and 21B are diagrams showing mask patterns usable in the above embodiment. Here, a case of the multi-pass print of the four-pass is shown as similar to FIGS. 11A and 11B already explained. FIG. 21A shows a mask pattern for colored inks, and FIG. 21B shows a mask pattern for the image improving liquids CL1 and CL2.

As seen from the figures, a pattern having a print allowance rate of 50%, in which a first-pass and a second-pass have a complementary relationship with each other, is allotted to the mask pattern for the colored ink, and the print allowance rate is 0% in a third-pass and in a fourth-pass. That is, a print of all print data is completed by the first-pass and the second-pass, and a print is not performed in the third-pass and the fourth-pass. On the other hand, a pattern having a print allowance rate of 50%, in which the third-pass and the fourth-pass have a complementary relationship with each other, is allotted to the mask pattern for the image improving liquid, and the print allowance rate is 0% in the first-pass and in the second-pass.

When such a mask pattern is used, in the same image region on the print medium, after a print by the colored inks is completed in the first-pass and the second-pass, the image improving liquids are applied in the third-pass and the fourth-pass.

It should be noted that, in the above embodiment, FIG. 8 is used to execute the processes from the pre-process J02 to production of the print data J06 by the host device 110 and execute the processes after the dot arrangement patterning process J07 by the printing device 210, but the present invention is not limited thereto. For example, all the processes from the pre-process to the printing operation may be executed by one inkjet printing apparatus, or a series of image processes until the mask process may be executed by the host device and the printing apparatus may execute only the printing operation according to the received binary data. In any case, if an embodiment is made in such a manner that the color mode and the monochromatic mode are prepared and a ratio in print duty between the first image improving liquid CL1 and the second image improving liquid CL2 is independently set to each of them, the embodiment is within a scope of the inkjet printing system of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194744, filed Aug. 31, 2010, which is hereby incorporated by reference herein in its entirety.

What is claimed is:

1. An inkjet printing system using a print head for ejecting a plurality of pigment inks, a first image improving liquid, and a second image improving liquid being more penetrative into a print medium than the first image improving liquid to print an image on the print medium, comprising:

a setting unit configured to set, to each of a color mode for using the plurality of the pigment inks to print on the print medium based on color image data and a monochromatic mode for using the plurality of the pigment inks having the less kind in number than the color mode to print on the print medium based on an achromatic image data, a print duty of each of the first image improving liquid and the second image improving liquid to the print medium, wherein the setting unit sets the print duty of each of the first image improving liquid and the second image improving liquid in such a manner that a ratio of the print duty of the first image improving liquid to the print duty of the second image improving liquid is higher in the monochromatic mode than that in the color mode.

2. An inkjet printing system according to claim 1, wherein the first image improving liquid and the second image improving liquid contain resins.

3. An inkjet printing system according to claim 1, wherein the first image improving liquid has a high ratio of resin components remaining on a surface of the print medium, and the second image improving liquid has a lower ratio of the resin components remaining on the surface of the print medium than the first image enhance solution.

4. An inkjet printing system according to claim 1, wherein the first image improving liquid and the second image improving liquid do not contain colorants.

5. An inkjet printing system according to claim 1, wherein the first image improving liquid contains a colorant.

6. An inkjet printing system according to claim 1, wherein the first image improving liquid contains an achromatic colorant.

7. An inkjet printing system according to claim 1, wherein in the color mode, the print duty of the second image improving liquid is higher than the print duty of the first image improving liquid, and in the monochromatic mode, the print duty of the first image improving liquid is higher than the print duty of the second image improving liquid.

8. An inkjet printing system according to claim 1, wherein in the color mode, the print duty of the first image improving liquid is 0%.

9. An inkjet printing system according to claim 1, wherein in the monochromatic mode, the print duty of the second image improving liquid is 0%.

10. An inkjet printing system according to claim 1, wherein the setting unit sets the print duty of each of the first image improving liquid and the second image improving liquid in accordance with print duties of the plurality of the pigment inks, and the setting unit sets, in all the print duties of the plurality of the pigment inks excluding a highlight region where a sum of the print duties of the plurality of the pigment inks is a low value including 0%, the print duty of each of the first image improving liquid and the second image improving liquid in such a manner that the ratio of the print duty of the first image improving liquid to the print duty of the second image improving liquid is higher in the monochromatic mode than that in the color mode.

11. An inkjet printing system according to claim 1, wherein the setting unit sets the print duty of the first image improving liquid and the print duty of the second image improving liquid to be different from each other corresponding to the kind of the print medium.

12. An inkjet printing system according to claim 1, further comprising:

a unit configured to control a print order of the same image region on the print medium in such a manner that the print of the plurality of the pigment inks by the print head is completed and thereafter, the print of the first image improving liquid or the second image improving liquid is performed by the print head.

13. An inkjet printing system according to claim 1, wherein the setting unit is configured to convert input signals of RGB into a plurality of output signals corresponding to the plurality of the pigment inks, the first image improving liquid and the second image improving liquid respectively, and the setting unit converts the input signals of RGB into the output signals of the first image improving liquid and the second image improving liquid in such a manner that the ratio of the print duty of the first image improving liquid to the print duty of the second image improving liquid is higher in the monochromatic mode than that in the color mode.

14. An inkjet printing system using a print head for ejecting a plurality of pigment inks, a first image improving liquid, and a second image improving liquid being more penetrative into a print medium than the first image improving liquid to print an image on the print medium, comprising:

a setting unit configured to set, to each of a color mode for using the plurality of the pigment inks to print on the print medium based on color image data and a monochromatic mode for using the plurality of the pigment inks having the less kind in number than the color mode to print on the print medium based on an achromatic image data, a used amount of each of the first image improving liquid and the second image improving liquid to the print medium, wherein the setting unit sets the used amount of each of the first image improving liquid and the second image improving liquid in such a manner that a ratio of the used amount of the first image improving liquid for printing an intermediate gradation image to the print duty of the second image improving liquid in the monochromatic mode is higher than that in the color mode.

15. An inkjet printing method for using a print head for ejecting a plurality of pigment inks, a first image improving liquid, and a second image improving liquid having higher penetratability onto a print medium than the first image improving liquid to print an image on the print medium, comprising:

a printing step for printing an image by a color mode for using the plurality of the pigment inks to print a color image on the print medium or a monochromatic mode for using the plurality of the pigment inks having the less kind in number than the color mode to print an achromatic image on the print medium, wherein in the printing step, a ratio of the print duty of the first image improving liquid to the print duty of the second image improving liquid is higher in the monochromatic mode than that in the color mode.

* * * * *